US007665731B2

(12) United States Patent
Shingai

(10) Patent No.: US 7,665,731 B2
(45) Date of Patent: Feb. 23, 2010

(54) SHEET CONVEYING DEVICE

(75) Inventor: Hiroyuki Shingai, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 72 days.

(21) Appl. No.: 11/930,670

(22) Filed: Oct. 31, 2007

(65) Prior Publication Data

US 2008/0169602 A1 Jul. 17, 2008

(30) Foreign Application Priority Data

Nov. 14, 2006 (JP) ..... 2006-308410

(51) Int. Cl.
*B65H 7/02* (2006.01)

(52) U.S. Cl. ..... 271/265.02; 399/371

(58) Field of Classification Search ..... 271/265.02, 271/265.01, 259, 258.01, 3.15–3.17, 4.02, 271/4.03, 10.02, 10.03, 262, 263, 265.04; 399/371; 358/488

See application file for complete search history.

(56) References Cited

U.S. PATENT DOCUMENTS 3,863,913 A * 2/1975 Hirafuji ..... 271/265.02
4,072,306 A * 2/1978 Idstein ..... 271/3.16
4,877,229 A * 10/1989 Delbe et al. ..... 271/2
6,042,109 A * 3/2000 Klausbruckner ..... 271/225
6,328,300 B1 * 12/2001 Stefan et al. ..... 271/2
6,926,272 B2 * 8/2005 Carter et al. ..... 271/258.01
7,234,695 B2 * 6/2007 Tsukamoto et al. ..... 271/122
7,451,983 B2 * 11/2008 Neubauer et al. ..... 271/266
2007/0018383 A1 * 1/2007 Ohara et al. ..... 271/262
2007/0090591 A1 * 4/2007 Roberts ..... 271/258.01

FOREIGN PATENT DOCUMENTS

JP 56048343 A * 5/1981
JP 61197346 A * 9/1986
JP 02233434 A * 9/1990
JP 08-202178 8/1996
JP 2006-117382 5/2006

* cited by examiner

*Primary Examiner*—Patrick H Mackey
*Assistant Examiner*—Jeremy Severson
(74) *Attorney, Agent, or Firm*—Banner & Witcoff, Ltd.

(57) ABSTRACT

A sheet conveying device of an aspect of the invention includes: a conveying path that allows a sheet to be conveyed and includes a first guide face and a second guide face opposing and apart from each other at a predetermined interval; a sheet conveying unit disposed on the conveying path; and a first detecting unit and a second detecting unit arranged opposing each other across the conveying path. Each of the first and second detecting unit includes: an arm member rotatably supported to take a posture where the arm member projected from the guide face to the conveying path and a posture where the arm member is retracted from the conveying path by rotating toward the guide face; and a first sensor that outputs a signal depending on the posture of the arm member.

14 Claims, 12 Drawing Sheets

T10
T11
T12
T13
ON
OFF
Δt1
Δt2
P
T20
T21
Δt1/2
Δt2/2
picture
Q1
Q2

T10
T11
T12
T13
ON
OFF
Δt1
Δt2
T20
T30
T21
T31
P
Δt1/2
Δt2/2
picture
picture
picture

SHEET CONVEYING DEVICE

CROSS-REFERENCE TO RELATED APPLICATIONS

This application is based upon and claims the benefit of priority from Japanese Patent Application No. 2006-308410, filed on Nov. 14, 2006, the entire contents of which are incorporated herein by reference.

TECHNICAL FIELD

One aspect of the invention relates to a sheet conveying device provided with a detecting unit configured to detect a sheet conveyed on a conveying path.

BACKGROUND

There is an image reading apparatus mounted on a copying machine, a printer and a multi function device having these functions integrally. For example, JP-A-2006-117382 discloses an image reading apparatus provided with a document feeder which is called ADF (Auto Document Feeder). In the document feeder, documents are conveyed from a sheet feeding tray through a conveying path to a sheet discharging tray. Then, documents conveyed by the document feeder are read by an image sensor arranged at a predetermined position on the conveying path.

JP-A-8-202178 discloses an image forming apparatus provided with transfer rollers capable of moving along the conveying direction of recording paper for the purpose of allowing the recording paper to advance stably into a fixing unit when recording paper in a curved form is conveyed.

SUMMARY

According to an aspect of the invention, there is provided a sheet conveying device including: a conveying path that allows a sheet to be conveyed and includes a first guide face and a second guide face opposing and apart from each other at a predetermined interval; a sheet conveying unit disposed on the conveying path; and a first detecting unit and a second detecting unit arranged opposing each other across the conveying path, wherein the first detecting unit includes: a first arm member rotatably supported to take a first posture where the first arm member projected from the first guide face to the conveying path and a second posture where the second arm member is retracted from the conveying path by rotating toward the first guide face; and a first sensor that outputs a signal depending on the first posture or the second posture of the first arm member, and wherein the second detecting unit includes: a second arm member rotatably supported to take a third posture where the second arm member is projected from the second guide face to the conveying path and a fourth posture where the second arm member is retracted from the conveying path by rotating toward the second guide face; and a second sensor that outputs a signal depending on the third posture or the fourth posture of the second arm member.

DESCRIPTION

In some of document feeders, sheets such as documents and recording paper are conveyed through a conveying path to a predetermined position (for example, a reading position or an image recording position) on a conveying path. In this case, for example, a sensor is disposed on the conveying path to detect the sheets conveyed on the conveying path. In the document feeder, the position of a sheet on the conveying path is judged on the basis of a sensor signal output from the sensor.

Figure 9A:
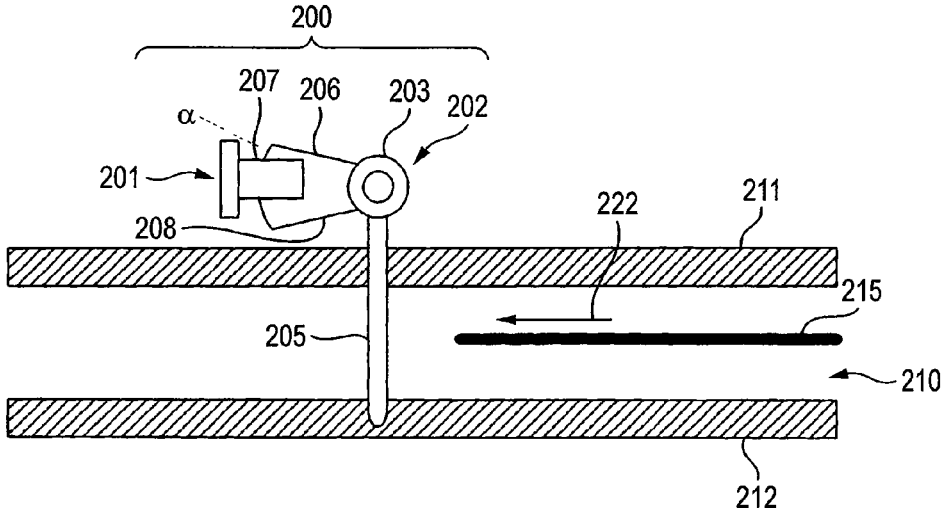
FIGS. 9A to 9C are sectional views schematically showing a structure of a sensor 200 arranged on the conveying path 210.
Figure 9B:
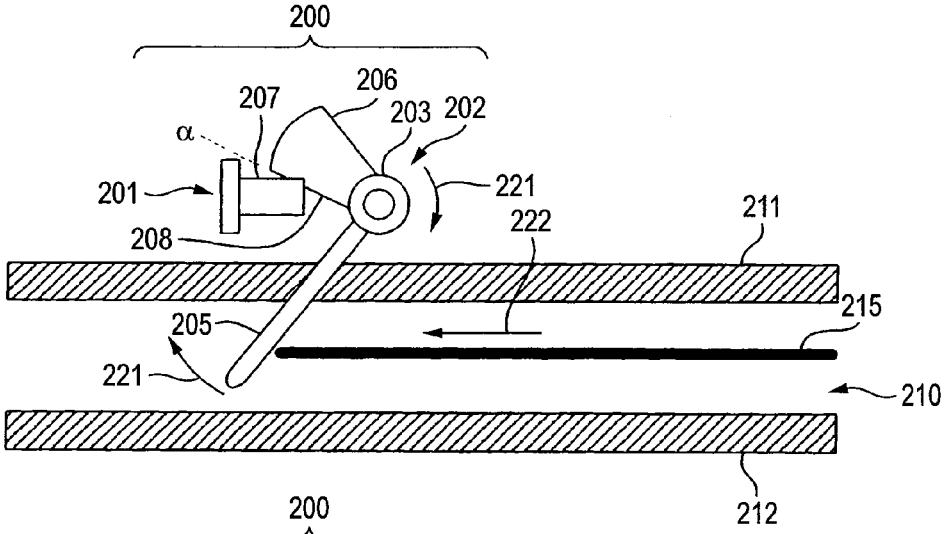
Figure 9C:
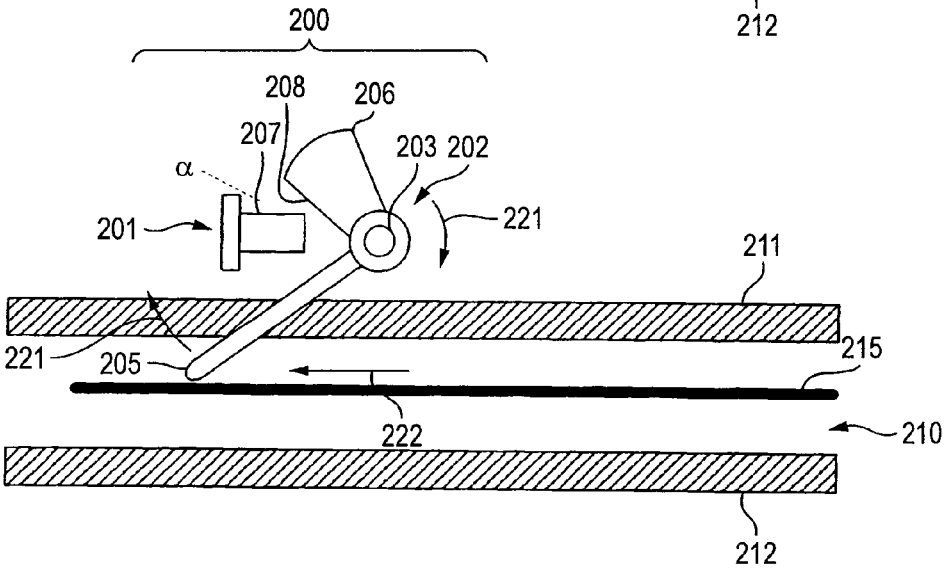
Figure 10A:
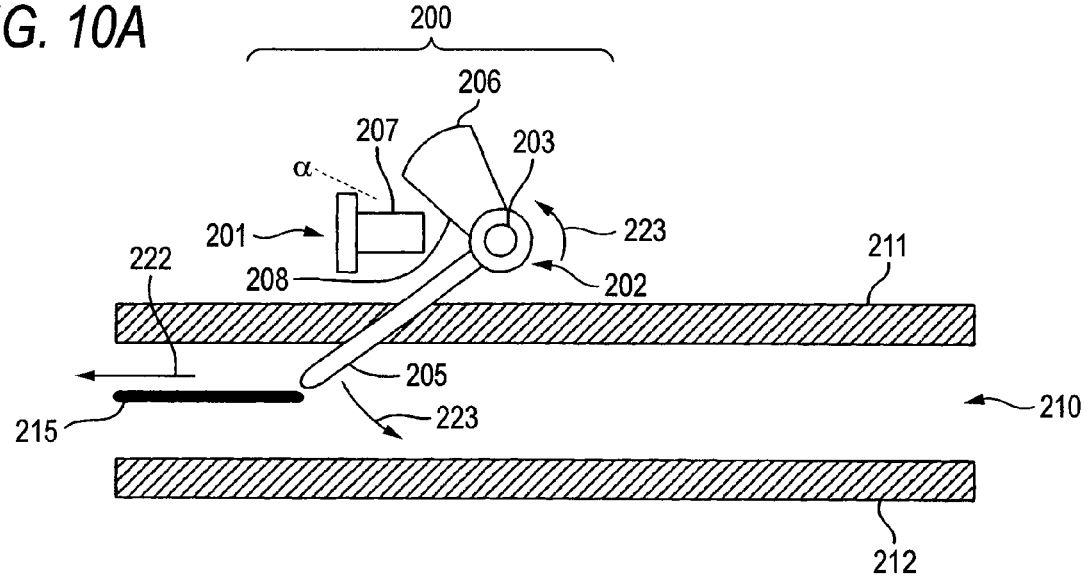
FIGS. 10A and 10B are sectional views schematically showing the structure of a sensor 200 arranged on the conveying path 210.
Figure 10B:
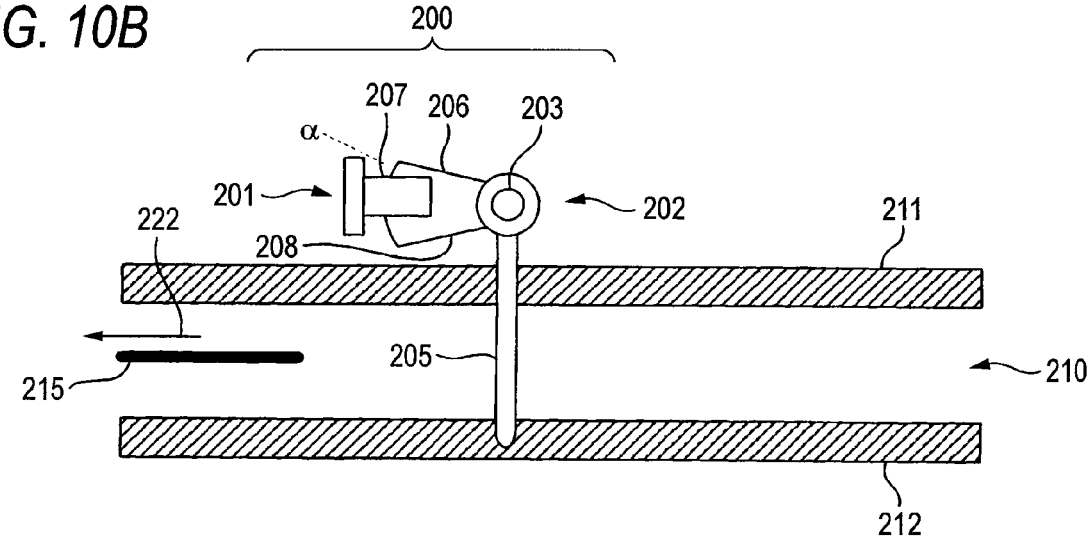

At first, the sensor generally provided in the document feeder is described with reference to FIGS. 9A to 12B. As shown in FIGS. 9A to 9C and FIGS. 10A and 10B, the above-described sensor includes, for example, a so-called actuator-type sensor 200 including a photo interrupter 201 and an actuator 202. In this instance, FIGS. 9A to 9C and FIGS. 10A and 10B are sectional views schematically showing a structure of the sensor 200 arranged on the conveying path 210. FIG. 9A shows a state before a sheet 215 is detected (non-detection state), FIG. 9B shows a state when the sheet 215 is detected (detection state), and FIG. 9C shows a state that the sheet 215 has pushed away an actuator 202 and passed over a sensor 200 (passage state). Further, FIG. 10A shows a state before the trailing end of the sheet 215 passes over the sensor 200, FIG. 10B shows a state immediately after the trailing end of the sheet 215 has passed over the sensor 200.

As shown in FIGS. 9A to 9C and FIGS. 10A and 10B, the actuator 202 is provided with an axis 203, an arm 205 extended from the axis 203 and a detected object 206. The actuator 202 is supported to move rotationally centering around the axis 203. The arm 205 is projected to the conveying path 210 and the detected object 206 is allowed to enter a detection area 207 of a photo interrupter 201 depending on the rotational movement of the actuator 202.

The sensor 200 is actuated as follows. In the non-detection state as shown in FIG. 9A, the arm 205 projects from the upper guide 211 to the conveying path 210, and the leading end thereof has arrived at a lower guide 212. The detected object 206 is positioned in the detection area 207 of the photo interrupter 201. In this instance, the photo interrupter 201 outputs an off signal (low level signal) which indicates that the sheet 215 is not detected. The sheet 215 moves to the direction (movement direction of the sheet 215) indicated by an arrow 222, and the leading end is in contact with the arm 205. Then, as shown in FIG. 9B, the arm 205 is pushed in the direction of the arrow 222, and the actuator 202 starts moving rotationally in the direction of the arrow 221. In association with this movement, the detected object 206 also moves rotationally in the same direction (the direction indicated by the arrow 221). When the sheet 215 moves further in the direction of the arrow 222 and the lower end 208 of the detected object 206 moves rotationally from the non-detection state shown in FIG. 9A to a position α shown in FIG. 9B, the detected object 206 completely exits from the detection area 207. In this instance, the photo interrupter 201 outputs an on signal (high level signal) which indicates that the sheet 215 is detected. Thereafter, as shown in FIG. 9C, the sheet 215 pushes away the arm 205 and passes over the sensor 200.

Further, as shown in FIG. 10A, when the trailing end of the sheet 215 comes through the arm 205, the arm 205 moves rotationally in the direction of the arrow 223. Thereby, as shown in FIG. 10B, the actuator 202 is returned to an original posture at which the arm 205 is projected to the conveying path 210 and the detected object 206 enters into the detection area 207 of the sensor 201.

Figure 11A:
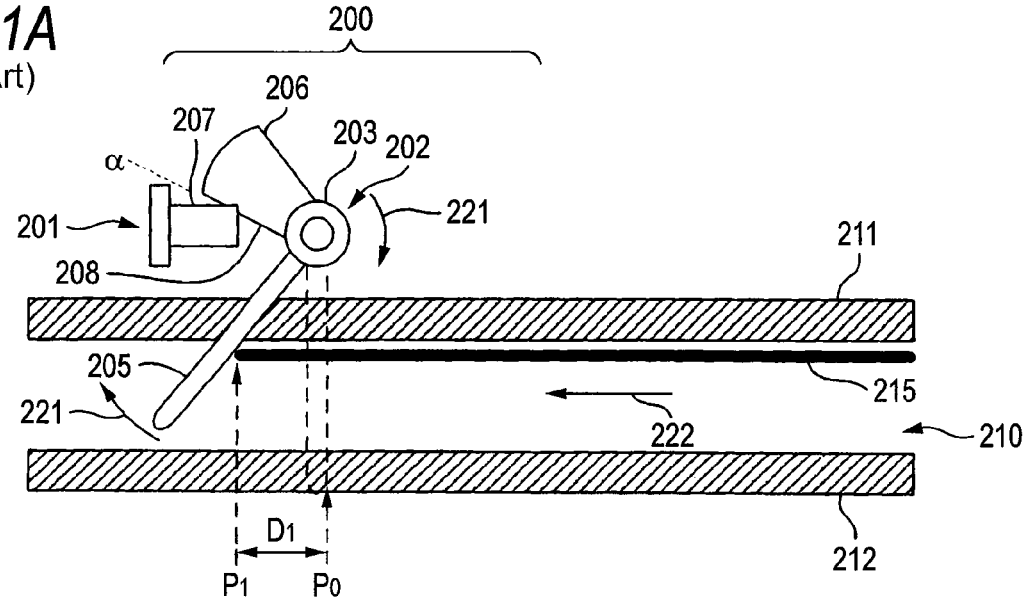
FIG. 11A (Prior Art)
FIGS. 11A and 11B are sectional views schematically showing the structure of a conventional sensor 200 arranged on the conveying path 210.
Figure 11B:
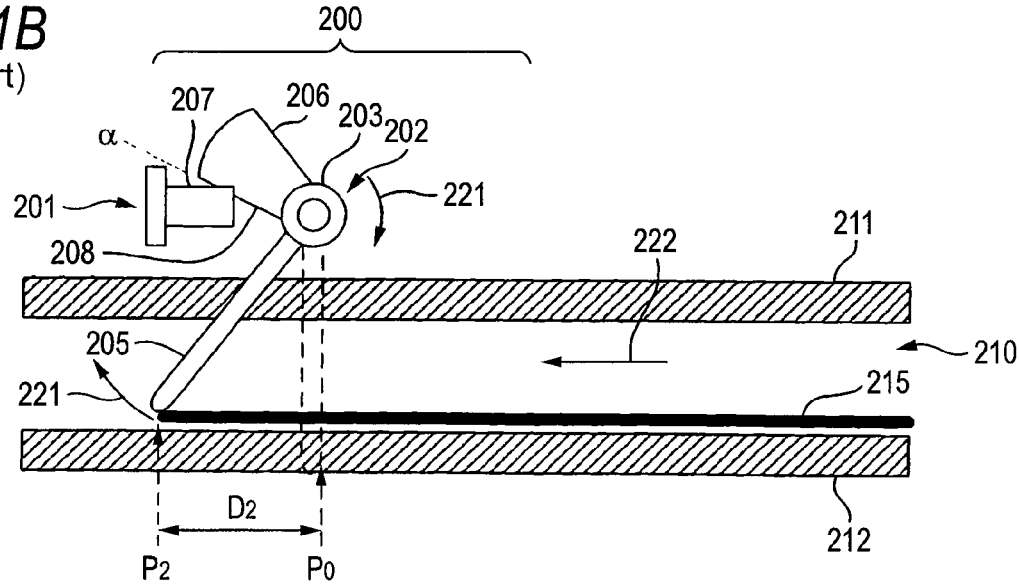
FIG. 11B (Prior Art)

However, sheets may pass through any given route at a space held between an upper guide and a lower guide on a conveying path. In other words, in the above space, there is no restriction on a passage route of the sheets. Therefore, the sheets do not always pass through the same predetermined route on the conveying path. As shown in FIGS. 11A and 11B, for example, there is a case where the sheet 215 moves along and proximity to an upper guide face 211 on the conveying path 210 (refer to FIG. 11A) and there is a case where it moves along and proximity to the lower guide face 212 (refer to FIG. 11B). As shown in FIG. 11A, when the sheet 215 moves along and proximity to the upper guide face 211, the leading end of the sheet 215 is in contact with a position near the axis 203 of the arm 205. On the other hand, as shown in FIG. 11B, when the sheet 215 moves along and proximity to the lower guide face 212, the leading end of the sheet 215 is brought into contact with a position distant from the axis 203 of the arm 205. In the former case, when the sheet 215 advances from a stationary position P0 of the arm 205 (refer to the dotted line in the drawing) in the non-detection state to a position P1 apart in a distance of D1, the detected object 206 arrives at the position α, by which the sheet 215 is detected. On the other hand, in the latter case, unless the sheet 215 advances from the stationary position P0 into a position P2 which is apart in a distance of D2 (>D1) longer than the distance of D1, the detected object 206 will not arrive at the position α. Therefore, where the sensor 200 is used to detect the sheet 215, in the above example, there is found an error of ΔD12 (=D2−D1) at a conveyance position of the sheet 215 at the time when the sheet is detected by the sensor 200 (detection timing) depending on a difference in route through which the sheet 215 moves.

Figure 12A:
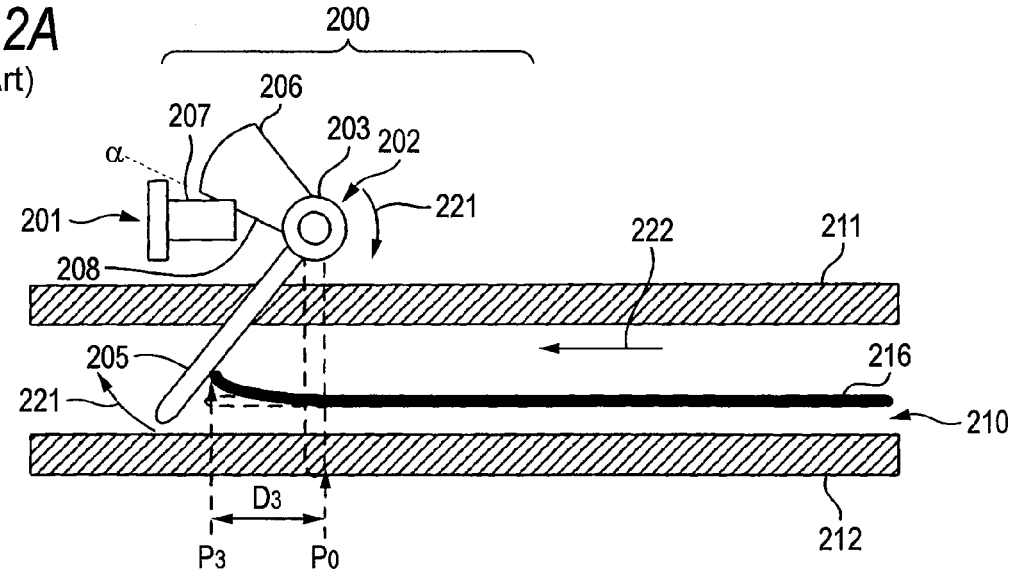
FIG. 12A (Prior Art)
FIGS. 12A and 12B are sectional views schematically showing the structure of a conventional sensor 200 arranged on the conveying path 210.
Figure 12B:
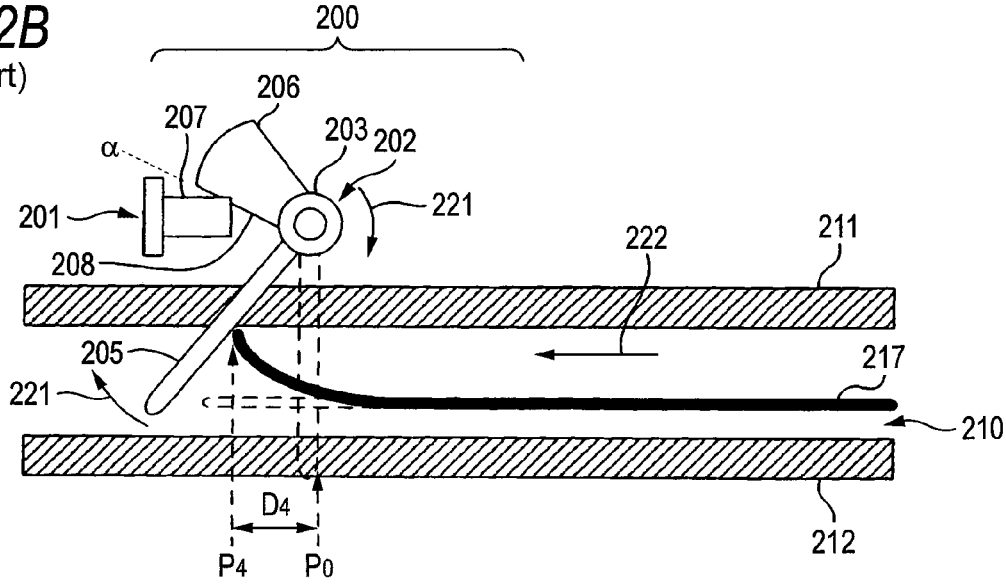
FIG. 12B (Prior Art)

Moreover, there is a case where conveying sheets may be curled on a curved conveying path. The extent of curl given to a sheet varies depending on the thickness or material of the sheet, the grain of material of the sheet (long grain or short grain), degree of elasticity, environmental factors in conveyance (humidity, temperature or the like). For example, as shown in FIGS. 12A and 12B, a position at which the leading end of each of the sheets 216, 217 is in contact with the arm 205 differs depending on a case where a slightly curled sheet 216 is conveyed on the conveying path 210 (refer to FIG. 12A) and a case where a greatly curled sheet 217 is conveyed on the conveying path 210 (refer to FIG. 12B). Therefore, positions at which each of the sheets 216, 217 is conveyed at the time of detection by the sensor 200 (P3, P4) mutually differ, thereby causing an error of ΔD34(=D4−D3) at a conveyance position.

In view of the above situation, an aspect of the invention provides a sheet conveying device that outputs a signal capable of correctly judging whether the leading end or the trailing end of a sheet moving on the conveying path has arrived at a predetermined position.

Another aspect of the invention provides a correct judgment whether the leading end or the trailing end of a sheet moving on a conveying path has arrived at a predetermined position.

A still another aspect of the invention provides an increase of the accuracy of image processing such as reading processing of images of a document and image recording processing of recording paper.

Hereinafter, a description will be given for an illustrative aspect of the present invention by referring to appropriate drawings. It is noted that the illustrative aspect is only one example of the present invention and, as a matter of course, the illustrative aspect may be appropriately modified within a scope not deviating from the spirit of the present invention.

Figure 1:
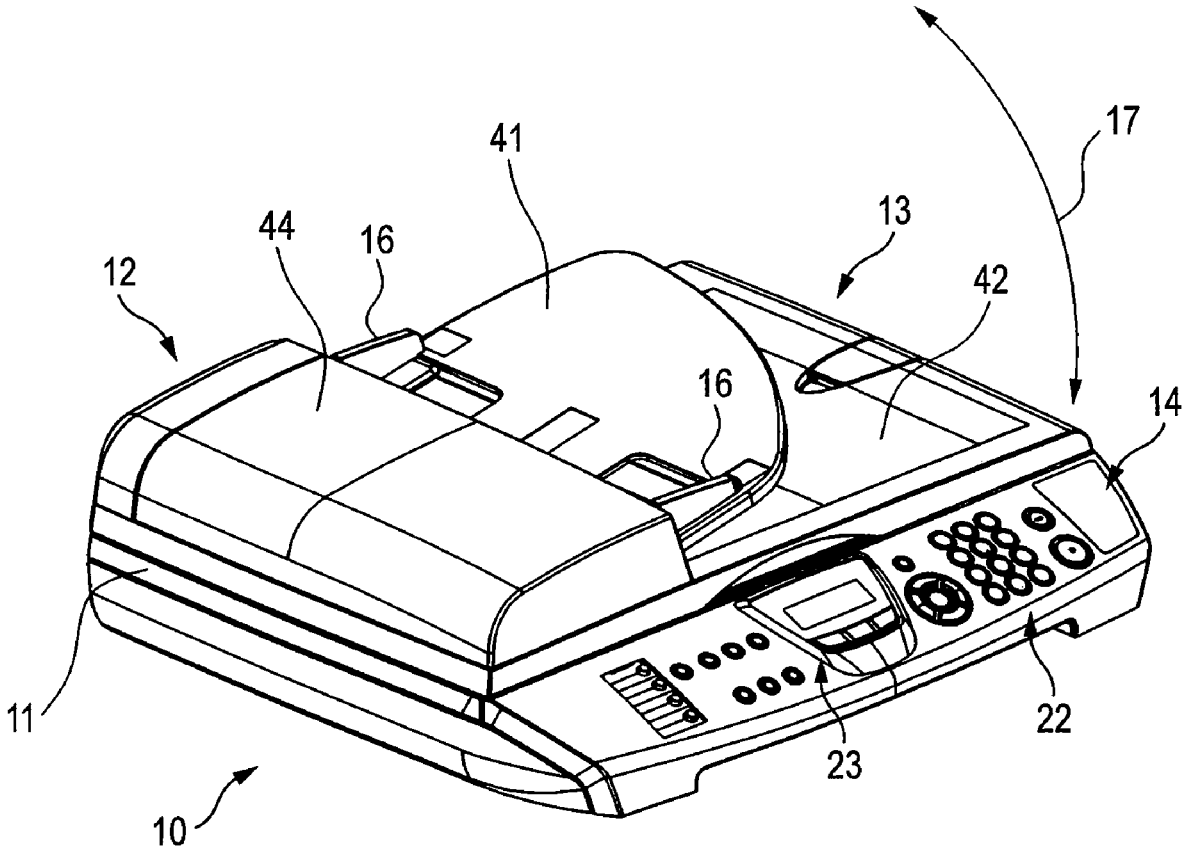
FIG. 1 is a perspective view of an outer structure of the image reading apparatus 10 related to an illustrative aspect of the present invention.
Figure 2:
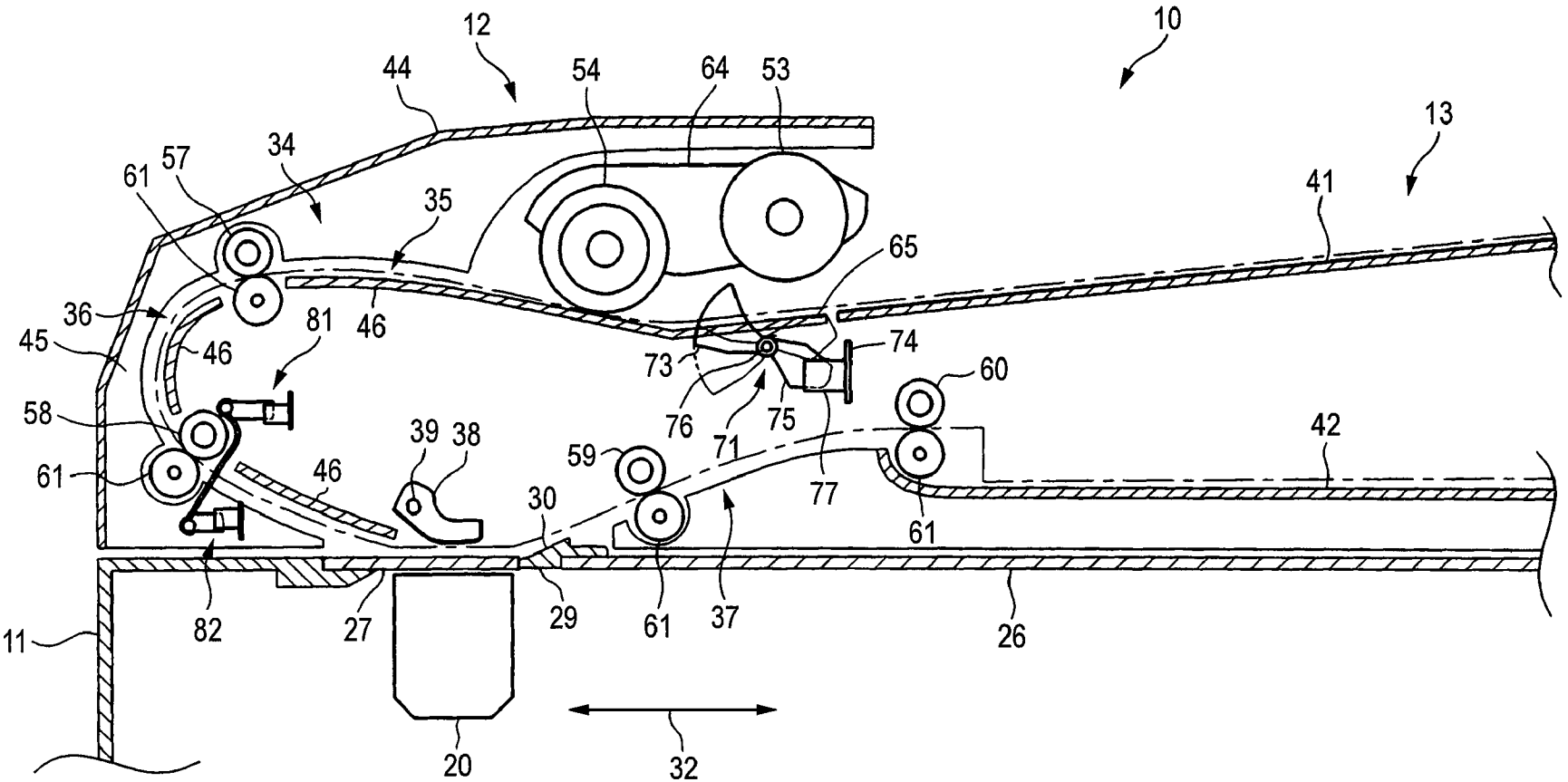
FIG. 2 is a sectional view of an inner structure of the image reading apparatus 10.

FIG. 1 is a perspective view showing an outer structure of the image reading apparatus 10 of an illustrative aspect in the present invention. Further, FIG. 2 is a sectional view schematically showing an inner structure of the image reading apparatus 10. The image reading apparatus 10 is used in a scanner, facsimile machine and a multi function device (MFD) having their functions. Hereinafter, a description will be given for a brief structure of the image reading apparatus 10 by referring to FIG. 1 and FIG. 2.

As shown in FIG. 1, the image reading apparatus 10 mainly includes an apparatus main body 11, a cover 13 and an operation panel 14.

As shown in FIG. 1, the apparatus main body 11 is greater in width and depth than in height and formed into a wide and thin rectangular solid shape. In the apparatus main body 11, when the image reading apparatus 10 functions as a flatbed scanner (FBS), the upper face thereof forms a document placing face. Although the details will be described later, a contact glass plate 26 (refer to FIG. 2) which forms the document placing face is disposed on the apparatus main body 11, and an image reading unit 20 (refer to FIG. 2) is disposed inside the apparatus main body 11.

The document cover 13 is disposed on the apparatus main body 11. The document cover 13 is attached with hinges so as to open and close freely in the direction given by the arrow 17 at the back of the apparatus main body 11 (upper side on the drawing). An auto document feeder (ADF) 12 is mounted on the document cover 13. The ADF 12 is an example of a sheet conveying device.

An operation panel 14 is disposed on the front face (forward side on the drawing sheet of FIG. 1) of the apparatus main body 11. The operation panel 14 includes various operation keys 22 and a liquid crystal display portion 23. A user inputs desired instructions by using the operation panel 14. For example, a "start key" for instructing the start of reading documents and a "halt key" for instructing the halt of reading are depressed, thus various instructions are output. Further, the operation keys 22 are used to select various reading modes. Upon receipt of the above predetermined input, the image reading apparatus 10 performs predetermined operations depending on the input concerned. The image reading apparatus 10 is connected to a computer and activated by instructions sent through a printer driver, a scanner driver or the like from the computer, in addition to the instructions input from the operation panel 14.

As shown in FIG. 2, contact glass plates 26, 27 are disposed on the upper face of the apparatus main body 11 opposed to the document cover 13. The document cover 13 is opened with respect to the upper face of the apparatus main body 11, by which the contact glass plates 26, 27 are exposed. Further, the document cover 13 is closed with respect to the upper face of the apparatus main body 11, by which the upper face of the apparatus main body 11 including the contact glass plates 26, 27 is entirely covered. An image reading unit 20 is disposed inside the apparatus main body 11. The image reading unit 20 is built into the apparatus main body 11 so as to oppose the lower face of the contact glass plates 26, 27 (the inner face which is not exposed).

The contact glass plate 26 is a place at which documents are placed when the image reading apparatus 10 is used as a FBS. The contact glass plate 26 is formed into a size corresponding to a maximum sized document which can be read by the image reading apparatus 10. An opening is formed centering around the upper face of the apparatus main body 11, and the contact glass plate 26 is supported on the periphery of the opening. The contact glass plate 26 exposed to the upper face of the apparatus main body 11 is given as a document reading area in the FBS.

The contact glass plate 27 includes a reading position at which images of a document conveyed by the ADF 12 are read. The contact glass plate 27 is formed in a narrow and long shape. The longitudinal direction of the contact glass plate 27 corresponds to the length of the main scanning direction (in the direction perpendicular to the sheet face in FIG. 2) of the image reading unit 20. The contact glass plate 27 is arranged laterally with respect to the contact glass plate 26. An opening for exposing the contact glass plate 27 is formed on the upper face of the apparatus main body 11, and the contact glass plate 27 is supported on the periphery of the opening.

A positioning member 29 is disposed between the contact glass plate 26 and the contact glass plate 27. The positioning member 29 is a narrow and long flat-plate like member. The longitudinal direction of the positioning member 29 corresponds to the main scanning direction of the image reading unit 20. The positioning member 29 is used as a reference for determining a position of placing documents when documents are placed on the contact glass plate 26. Marks indicating the center position and positions of both ends of various size documents such as A4 size and B5 size paper are given on the upper face of the positioning member 29. Further, a guide face 30 is formed on the upper face of the positioning member 29. The guide face 30 catches the leading end of a document which has passed over the contact glass plate 27, changes the moving direction and again guides the document into the ADF 12.

The image reading unit 20 is a so-called image sensor which irradiates light on a document from a light source through the contact glass plates 26, 27, concentrates reflected light from the document on a light receiving element, and then converts the reflected light to an electric signal. The image reading unit 20 includes, for example, a contact image sensor (CIS) and a charge coupled device (CCD) image sensor of a shrinkage optical system. The image reading unit 20 is provided so as to move reciprocally below the contact glass plates 26, 27 by a belt driving mechanism toward the direction of the arrow 32 shown in FIG. 2. When the image reading apparatus 10 functions as a FBS, upon receipt of a driving force of the carriage motor 107 (refer to FIG. 5), it moves parallel with the contact glass plate 26 and reads images of a document. When the image reading apparatus 10 reads images by using the ADF 12, it moves below the contact glass 27 and is on standby at the position.

As shown in FIG. 1 and FIG. 2, the document cover 13 includes a sheet feeding tray 41 and a sheet discharging tray 42. The sheet discharging tray 42 is arranged below the sheet feeding tray 41. The document cover 13 includes the ADF 12 which conveys documents from the sheet feeding tray 41 through the conveying path 34 to the sheet discharging tray 42.

A plurality of sheets of document can be placed on the sheet feeding tray 41. A plurality of sheets are placed on the sheet feeding tray 41 in such a way that the leading end of a document in the feeding direction is inserted into the conveying path 34, with the reading face placed upward.

A pair of document guides 16 (refer to FIG. 1) are provided on the sheet feeding tray 41 apart in the depth direction of the document cover 13. The document guides 16 are provided so as to slide in the depth direction of the apparatus. The document guides 16 are to regulate the position of a document in the width direction which is placed on the sheet feeding tray 41. In a pair of the document guides 16, when either of the document guides 16 is slid, the other document guide 16 is allowed to slide by a known interlocking mechanism.

The sheet discharging tray 42 is disposed below the sheet feeding tray 41 at a position apart in a vertical direction. The sheet discharging tray 42 is formed integrally on the upper face of the document cover 13. In other words, a part of the upper face of the document cover 13 forms the sheet discharging tray 42. A document discharged from the ADF 12 is retained so as to be stacked on the sheet discharging tray 42, with the reading face kept downward.

Hereinafter, a description will be given for a structure of the ADF 12 by referring to FIG. 2. As shown in FIG. 2, a conveying path 34 is formed inside the ADF 12. The conveying path 34 leads from the sheet feeding tray 41 over the reading position on the contact glass plate 27 to the sheet discharging tray 42. The conveying path 34 includes a curved path 36 (an example of the curved portion) which is folded back approximately at 180°. The conveying path 34 is formed approximately in a laterally-faced U-shape when viewed from the cross section. The conveying path 34 is formed with a frame and others which form the cabinet of the ADF 12 as a path having a predetermined clearance through which a document can pass through. In details, the conveying path 34 is partitioned by a guide rib 45 provided on an outer frame 44 of the ADF 12 and a guide plate 46 provided at a position opposed to the guide rib 45 apart at a predetermined interval. It is noted that the guide face 47 (refer to FIG. 3) on which the guide rib 45 is exposed to the conveying path 34 and the guide face 48 (refer to FIG. 3) on which the guide plate 46 is exposed to the conveying path 34 are examples of the first guide face and the second guide face, respectively.

As shown in FIG. 2, the conveying path 34 contains three parts, that is, an upper conveying path 35 extended from the sheet feeding tray 41 to one end of the document cover 13 (the left end in FIG. 2), a curved path 36 bent so as to reverse downward and extended to the reading position on the contact glass plate 27 and a lower conveying path 37 extended from the reading position to the sheet discharging tray 42.

An example of the supply unit and an example of the sheet conveying unit are disposed on the conveying path 34. As shown in FIG. 2, the supply unit includes a pickup roller 53 and a separation roller 54 provided most upstream (on the side of the sheet feeding tray 41) in the conveying direction on the conveying path 34. The sheet conveying unit includes conveying rollers 57 to 59, a discharge roller 60 and pinch rollers 61 which are in pressure contact therewith. A driving force is transferred from the motor 107 (refer to FIG. 5) to each of the rollers constituting the supply unit and the sheet conveying unit.

As shown in FIG. 2, the pickup roller 53 and separation roller 54 are provided in the vicinity of a feed port, that is, most upstream in the conveying direction on the conveying path 34. The pickup roller 53 is provided at the leading end of an arm 64, the base end of which is supported pivotally on the axis which supports pivotally the separation roller 54. The separation roller 54 is provided at a position apart in the conveying direction from the pickup roller 53 so as to rotate freely. A plate 65 is provided at a position opposed to the separation roller 54. The separation roller 54 is in pressure contact with the plate 65. A driving force is transferred from the motor 107 (refer to FIG. 5) to rotate and drive the pickup roller 53 and the separation roller 54. A driving force is transferred from the motor 107 to move the arm 64 up and down. The pickup roller 53 and the separation roller 54 are identical in diameter and rotated at the same peripheral speed. The plate 65 is provided with a friction pad at a position which is in pressure contact with the roller face of the separation roller 54. Sheets of the Document are separated one by one due to a friction generated by the friction pad and the separation roller 54 and fed to the conveying path 34.

The conveying rollers 57 to 59 are disposed respectively apart at appropriate intervals in the conveying direction at a predetermined position on the conveying path 34. In the present illustrative aspect, the conveying roller 57 is disposed at an upper conveying path 35 of the conveying path 34, the conveying rollers 58 is disposed at a lower conveying path 37 of the conveying path 34 and immediately at an upstream side of the reading position, and the conveying roller 59 is disposed at a lower conveying path 37 of the conveying path 34 and immediately at a downstream side of the reading position. It is noted that the thus arranged configuration of each of the conveying rollers 57 to 59 is just an example and the number of the conveying rollers 57 to 59 and the arrangement in the present invention are applicable to a modification made whenever necessary.

The pinch rollers 61 are provided at the positions opposed to the respective conveying rollers 57 to 59, in other words, at the position opposed to the respective conveying rollers 57 to 59 across the conveying path 34. Each of the pinch rollers 61 is elastically urged for the axis by a spring, by which it is in pressure contact with the roller face of each of the conveying rollers 57 to 59. When each of the conveying rollers 57 to 59 is rotated, each of the pinch rollers 61, which is in pressure contact therewith, is also rotated accordingly. A document is in pressure contact with each of the conveying rollers 57 to 59 by each of the pinch rollers 61, and a rotating force of each of the conveying rollers 57 to 59 is transferred to the document.

The discharge roller 60 is disposed most downstream of the conveying path 34 in the conveying direction, that is, in the vicinity of a discharge port. As with the conveying rollers 57 to 59, a driving force is transferred from the motor 107 (refer to FIG. 5) to rotate and drive the discharge roller 60. The pinch roller 61 is also provided at a position opposed to the discharge roller 60 across the conveying path 34. The pinch roller 61 is elastically urged by a spring and in pressure-contact with the discharge roller 60.

A document presser 38 is arranged opposed to the contact glass plate 27 in a state that the document cover 13 is closed. The document presser 38 is urged by urging member (not shown) on the basis of the axis 39 in a clockwise direction as shown in FIG. 2. Thereby, the document presser 38 is in pressure-contact with the contact glass plate 27. Even when a sheet containing curled leading or trailing ends is delivered to a reading position on the contact glass plate 27, the leading end and the trailing end of the document is stretched out by the document presser 38 and conveyed in a state that it is firmly attached to the contact glass plate 27.

As shown in FIG. 2, a plurality of sensors configured to detect the conveyance of documents are provided on the conveying path 34. In detail, a front sensor 71 is disposed immediately at an upstream side of the separation roller 54 on the conveying path 34. Further, the first rear sensor 81 (one example of the first detecting unit) and the second rear sensor 82 (one example of the second detecting unit) are disposed immediately at an upstream side of the reading position on the contact glass plate 27.

Hereinafter, a description will be given in detail for a structure of the front sensor 71 by referring to FIG. 2. As shown in FIG. 2, the front sensor 71 includes: a detection arm 73 rotatable around an axis 76; and a photo interrupter 74. The detection arm 73 is projected upward from the plate 65 which is arranged opposed to the separation roller 54 and in contact with a document, thereby moving rotationally so as to retract from an upper conveying path 35. The photo interrupter 74 detects the rotational movement of the detection arm 73. A shielded portion 75 detected by the photo interrupter 74 is formed integrally on the detection arm 73. The detection arm 73 is elastically urged by urging member (not shown) such as a spring at a position at which the detection arm 73 is projected to the upper conveying path 35, that is, in a clockwise direction shown in FIG. 2. In a state that an external force other than the urge by the urging member is not applied to the detection arm 73, as shown by the solid line in FIG. 2, the detection arm 73 is projected to the upper conveying path 35 and the shielded portion 75 is positioned in a detection area 77 between the light emitting portion and the light receiving portion of the photo interrupter 74. Thereby, light transfer of the photo interrupter 74 is blocked to turn off the front sensor 71. In other words, an output signal of the front sensor 71 is at a low level.

When a document is placed on the sheet feeding tray 41, the leading end of the document is in contact with the detection arm 73, thereby allowing the detection arm 73 to move rotationally so as to retract from the upper conveying path 35. The shielded portion 75 is also moved rotationally together with the detection arm 73, and as shown in FIG. 2 by the two dot and dash line, the shielded portion 75 exits from the detection area 77 of the photo interrupter 74. Thereby, the light transfer of the photo interrupter 74 is not blocked to turn the front sensor 71 on. In other words, an output signal of the front sensor 71 is at a high level. The front sensor 71 is turned on and off, thereby making it possible to detect whether a document is placed on the sheet feeding tray 41.

The front sensor 71 is turned on and off, thereby detecting the leading end or the trailing end of a document conveyed on the upper conveying path 35. A judgment may be made for whether a document is fed from the sheet feeding tray 41 to the upper conveying path 35, for example, by referring to the front sensor 71 which detects the leading end of the document. Further, the number of rotations of the conveying rollers 57 to 59 after detection of the trailing end of the document by the front sensor 71 is monitored by referring to the number of steps and others of an encoder and the motor 107 (refer to FIG. 5), by which a judgment may be made for a position of the leading end or the trailing end of the document on the document conveying path.

Figure 3:
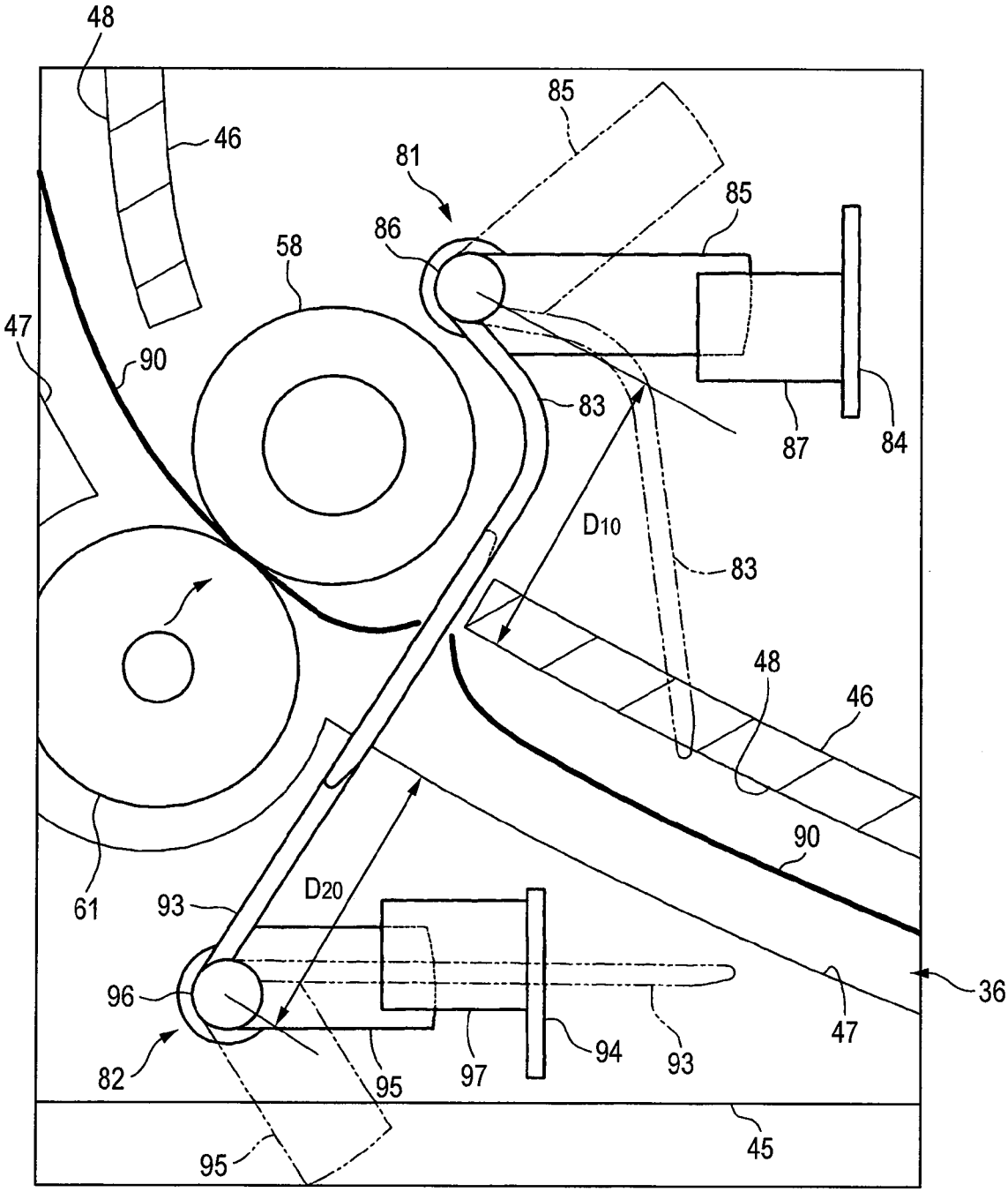
FIG. 3 is a partially enlarged view of a structure of the first rear sensor 81 and the second rear sensor 82.

FIG. 3 is a partially enlarged view showing a structure of the first rear sensor 81 and the second rear sensor 82. Hereinafter, a detailed description will be made for the structure of the first rear sensor 81 and the second rear sensor 82.

As shown in FIG. 3, the first rear sensor 81 is disposed inside the guide plate 46 on the curved path 36. The first rear sensor 81 includes a detection arm 83 (one example of the first arm member) and the photo interrupter 84 (one example of the first sensor in). The detection arm 83 is supported centering around the axis 86 so as to move rotationally freely. The detection arm 83 moves rotationally, by which the detection arm 83 changes in posture to the first posture projected so as to intersect with the curved path 36 (refer to the solid line in FIG. 3) and the second posture retracting from the curved path 36 to the inside the guide plate 46 (refer to the two dot and dash line in FIG. 3). Specifically, the detection arm 83 can take the following postures: a posture projected perpendicularly with respect to the curved path 36 from the inside of the guide plate 46 through an opening (not shown) formed on the guide plate 46 (corresponding the first posture); and a posture retracting from the curved path 36 to the inside of the guide plate 46 (corresponding to the second posture).

The photo interrupter 84 outputs a detection signal (current signal, voltage signal or the like) depending on the above-described first posture and the second posture. A shielded portion 85 detected by the photo interrupter 84 is formed integrally on the detection arm 83. The detection arm 83 is elastically urged by an urging member (not shown) to the first posture at which the detection arm 83 is projected to the curved path 36, in other words, in a counter clockwise direction shown in FIG. 3. The urging member includes, for example, a torsion spring which is fitted into the axis 86 of the detection arm 83. As a matter of course, the urging member may include springs such as a blade spring and a coil spring or other elastic members such as rubber.

In a state that no external force other than the urged force resulting from the urging member is applied to the detection arm 83, as shown by the solid line in FIG. 3, the detection arm 83 is projected to the curved path 36, and the shielded portion 85 is positioned in a detection area 87 between the light emitting portion and the light receiving portion of the photo interrupter 84. Thereby, light transferred by the photo interrupter 84 is blocked to turn the first rear sensor 81 off. Thus, a signal output from the first rear sensor 81 is at a low level.

As shown in FIG. 3, the second rear sensor 82 is disposed at a position opposed to the first rear sensor 81 across the curved path 36. The second rear sensor 82 has an approximately similar structure to the first rear sensor 81. The second rear sensor 82 includes a detection arm 93 (one example of the second arm member) and a photo interrupter 94 (one example of the second sensor). The detection arm 93 is supported by and rotatable around an axis 96 so as to change in posture, which allows to take a third posture (refer to the solid line in FIG. 3) where the detection arm 93 is projected to intersect with the curved path 36 and a fourth posture where the detection arm 93 is retracted from the curved path 36 to the guide rib 45 (refer to the two dot and dash line in FIG. 3). More specifically, the detection arm 93 can take the following postures: a posture projected perpendicularly with respect to the curved path 36 from the guide rib 45 (corresponding to the above-described third posture); and a posture retracting from the curved path 36 to the guide rib 45 (corresponding to the fourth posture). It is noted that in the present illustrative aspect, a description is made that the detection arm 83 and the detection arm 93 in the third posture are to intersect with the curved path 36. However, it is not always necessary that each of the detection arms 83, 93 intersects with the curved path 36.

In the present illustrative aspect, since the document guide 16 (refer to FIG. 1) is used to regulate a document so as to be centering around the conveying path 34, the first rear sensor 81 and the second rear sensor 82 are provided approximately centering around in the width direction of the curved path 36 (a direction perpendicular to the sheet face in FIG. 2 and FIG. 3). Further, in a state that no external force is applied, in order to retain the first and third postures projected to the curved path 36, the first rear sensor 81 and the second rear sensor 82 are disposed apart at a predetermined interval in the width direction of a document (a direction perpendicular to the space in FIG. 2) so that the detection arms 83, 93 of each of the rear sensors 81, 82 do not interfere with each other.

Further, in the present illustrative aspect, as shown in FIG. 3, the first rear sensor 81 and the second rear sensor 82 are disposed so that a distance D10 apart in a perpendicular direction from the guide face 48 of the curved path 36 to the axis 86 is equal to a distance D20 apart in a perpendicular direction from the guide face 47 of the curved path 36 to the axis 96. Thereby, the detection arms 83, 93 of the first rear sensor 81 and the second rear sensor 82 are made equal in rotation angle when they change in posture from the first and third postures to the second and fourth postures.

Figures 4A, 4B, 4C, 4D:
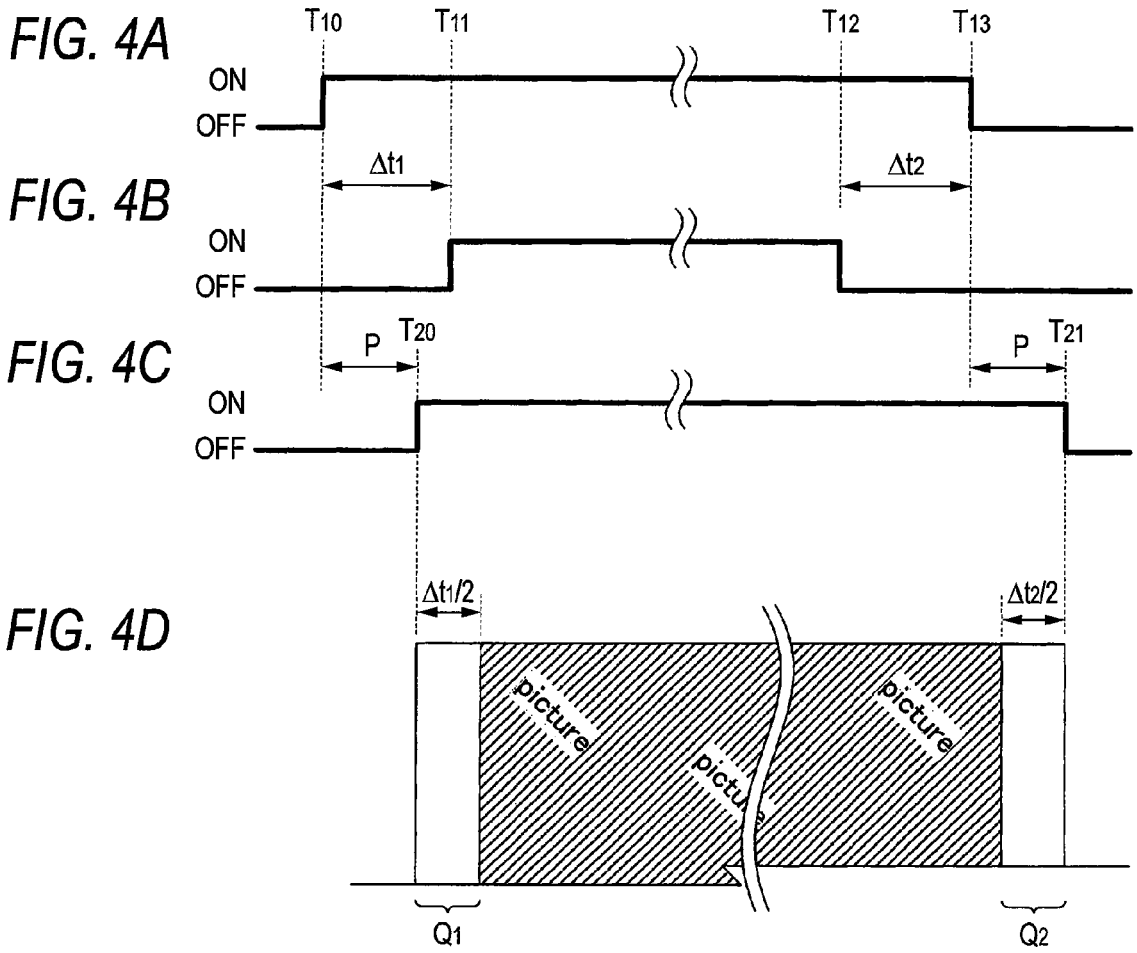
FIGS. 4A to 4D are views showing one example of the respective timing charts of the first rear sensor 81, the second rear sensor 82 and the image reading unit 20 as well as the image data.

Hereinafter, a description will be given by referring to FIG. 3 and FIGS. 4A to 4D for operations of the first rear sensor 81 and the second rear sensor 82 when a document 90 is conveyed to the curved path 36, specifically, the operations by which each of the rear sensors 81, 82 detects the leading end and the trailing end of the document 90. In this instance, FIG. 4A is a timing chart showing the operation of the first rear sensor 81, and FIG. 4B is a timing chart showing the operation of the second rear sensor 82.

On conveyance of the document 90 on the conveying path 36 or by the conveying roller 58, there is a case where the leading end or the trailing end thereof is curled. Hereinafter, as shown by the bold line in FIG. 3, the leading end and the trailing end of the document 90 are curled to the guide face 48 of the guide plate 46. A description will be given of a case where the leading end and the trailing end of the document move along the guide face 48 on the curved path 36.

As described above, when the document 90 having the curled leading end arrives at the first rear sensor 81 and the second rear sensor 82, the leading end of the document 90 comes into contact approximately at the same time with the respective detection arms 83, 93 of each of the rear sensors 81, 82.

As shown in FIG. 3, the leading end of the document 90 is in contact with the detection arm 83 which is orthogonal with the curved path 36 at a position near the axis 86. When the leading end of the document 90 is in contact with the detection arm 83, the detection arm 83 is pressed by the document 90 and starts to move rotationally. At this time, in association with the rotational movement of the detection arm 83, a shielded portion 85 also moves rotationally. When the detection arm 83 further moves rotationally and detection arm 83 changes in posture from the first posture to the second posture, as shown by the two dot and dash line in FIG. 3, the shielded portion 85 exits from the detection area 87 of the photo interrupter 84. Thereby, light from a light emitting element of the photo interrupter 84 is not received by a light receiving element, and the first rear sensor 81 is turned on (time T10 in FIG. 4A). In other words, the leading end of the document 90 is detected by the first rear sensor 81 at a time point (timing) of time T10.

When the leading end of the document 90 is also brought into contact with the detection arm 93, the detection arm 93 is pushed by the document 90 and moves rotationally, by which the shielded portion 95 also moves rotationally. However, the document 90 is conveyed, thereby the speed at which the detection arm 93 moves rotationally (rotating speed) is slower than the rotating speed of the detection arm 83. This is because whereas the leading end of the document 90 is in contact with the detection arm 83 at a position near the axis 86, the leading end of the document 90 is in contact with the detection arm 93 at a position distant from the axis 96. In other words, a difference in the rotating speed is derived from a difference in a perpendicular distance from the axes 86, 96 to the respective contact positions of the detection arms 83, 93. Therefore, time during which the detection arm 93 needs to change in posture from the third posture to the fourth posture is longer than time for which the detection arm 83 needs to change in posture. The shielded portion 95 exits from the detection area 97 of the photo interrupter 94 delayed only by Δt1 from the time T10. In other words, the leading end of the document 90 is detected by the second rear sensor 82 at a time point of time T11 delayed by Δt1 from the time T10.

As shown in FIG. 3, when the document 90 having the curled trailing end is conveyed and the trailing end thereof arrives at the first rear sensor 81 and the second rear sensor 82, the first rear sensor 81 and the second rear sensor 82 operate as follows.

When the trailing end of the document 90 comes through the detection arm 83 and the detection arm 93, each of the detection arms 83, 93 is urged by an urging member (not shown) and returned to the first or third posture. In this instance, the shielded portions 85, 95 enter into the detection areas 87, 97. Thereby, the first rear sensor 81 and the second rear sensor 82 are turned off. Here, since the trailing end of the document 90 is curled to the guide face 48, the detection arm 93 is released earlier from the document 90 than the detection arm 83 and returned to the third posture (time T12 in FIG. 4B). Thereafter, the detection arm 83 is returned to the first posture delayed only by Δt2 from the time T12 (time T13 in FIG. 4A). In other words, the trailing end of the document 90 is detected by the second rear sensor 82 at a time point of the time T12, and the trailing end of the document 90 is detected by the first rear sensor 81 at a time point of the time T13 delayed only by Δt2 from the time T12.

As described above, in the image reading apparatus 10 of the present illustrative aspect, the first rear sensor 81 and the second rear sensor 82 are provided on the ADF 12. Thus, when the leading end or the trailing end of a document is conveyed along and proximity to either the guide face 47 or the guide face 48 of the curved path 36, as shown in FIGS. 4A and 4B, it is possible to obtain a detection signal different in detection timing as the results detected respectively by the rear sensors 81, 82. Such detection results can be obtained when the leading end or the trailing end of a document does not pass over the center of the conveying path 36, irrespective of whether the leading end or the trailing end of the document is curled. It is noted that in the present illustrative aspect, the first rear sensor 81 and the second rear sensor 82 are provided at the curved portion 36. As a matter of course, similar detection results can be obtained when the rear sensors 81, 82 are respectively provided at an upper conveying path 35 and a lower conveying path 37 on the conveying path 34. Further, the above-described front sensor 71 may be replaced by a pair of sensors in which the first rear sensor 81 is combined with the second rear sensor 82. In this instance, similar detection results can also be obtained.

Figure 5:
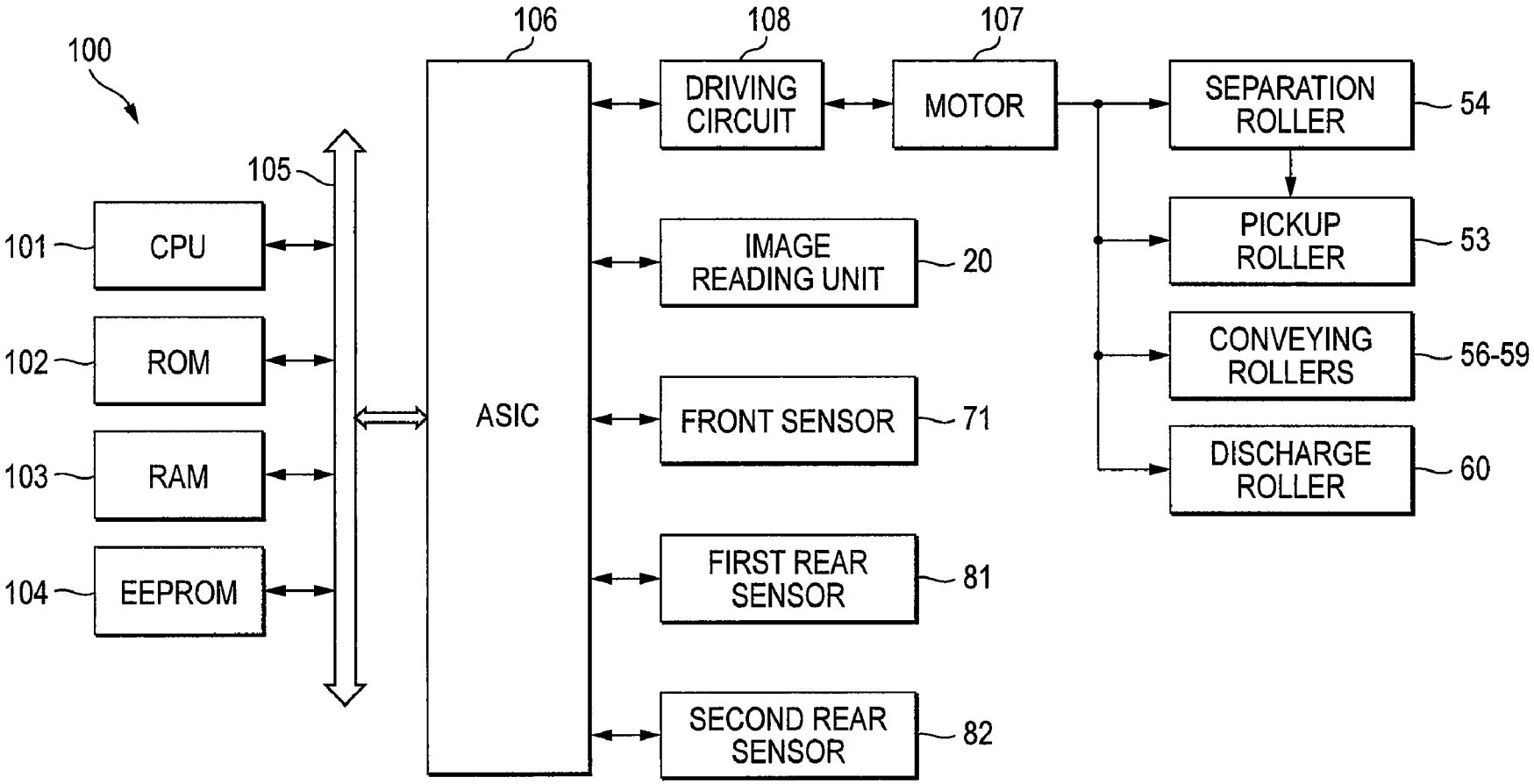
FIG. 5 is a block chart showing a structure of the controller 100 mounted on the image reading apparatus 10.

FIG. 5 is a block diagram showing a configuration of a controller 100 mounted on the image reading apparatus 10. The controller 100 is to comprehensively control a motor 107, which drives the separation roller 54, the conveying rollers 57 to 59, the discharge roller 60 or the like provided on the ADF 12, and an image reading unit 20 and others. Specifically, the controller 100 controls the motor 107 and the image reading unit 20 on the basis of sensor signals from the front sensor 71, the first rear sensor 81 and the second rear sensor 82. Hereinafter, a description will be given for the controller 100.

As shown in FIG. 5, the controller 100 is configured as a micro computer which is mainly based on a central processing unit (CPU) 101, a read only memory (ROM) 102, a random access memory (RAM) 103, an electrically erasable and programmable ROM (EEPROM) 104, and connected via a bus 105 to an application specific integrated circuit (ASIC) 106.

The ROM 102 accommodates programs and others for controlling various operations of the image reading apparatus 10 and the ADF 12. The RAM 103 is used as a storage area or a work area which temporarily stores various data used on execution of the above programs by the CPU 101 and as a storage area which accumulates and stores image data (read image) read by the image reading unit 20. The EEPROM 104 accommodates various settings and flags to be retained, even after a power source is turned off. The controller 100 including these components supplied with electricity from a backup power source (not shown) and able to retain information accommodated in the RAM 103, even if the power source of the apparatus is turned off. The control unit, the first judgment unit, the second judgment unit, the third judgment unit and the image erasing unit are realized by these CPU 101, ROM 102 and RAM 103.

The ASIC 106 generates a phase excitation signal and the like to energize the motor 107 according to instructions from the CPU 101, provide the signal to a driving circuit 108 of the motor 107, thereby rotating and controlling the motor 107 by providing a driving signal from the driving circuit 108 to the motor 107. The motor 107 rotates and drives either in a positive rotational direction or in a reverse rotational direction, thereby providing a driving force to the pickup roller 53, the separation roller 54, the conveying rollers 57 to 59 and the discharge roller 60. The motor 107 is a single driving source of the ADF 12. The motor 107 used in the present illustrative aspect is a stepping motor which can rotate and drive in either direction of a positive rotation (CW rotation) and a reverse rotation (CCW rotation) and which is driven and controlled by a pulse driving mode. As a matter of course, a motor driven by other modes may be used.

The driving circuit 108 is to drive the motor 107, generating a pulse signal for rotating the motor 107 on receipt of an output signal from the ASIC 106. The pulse signal is generated on the basis of a periodic signal generated at the ASIC 106. The pulse signal generated at the driving circuit 108 is output to the motor 107. On inputting the pulse signal, the motor 107 rotates in a predetermined rotational direction, thereby transferring a rotational force of the motor 107 via a driving-force transferring mechanism such as gears (not shown) to the pickup roller 53, the separation roller 54, the conveying rollers 57 to 59 and the discharge roller 60.

A periodic signal generated at the ASIC 106 is fed back via the bus 105 to the CPU 101. On the basis of the thus fed back periodic signal, the CPU 101 counts the number of pulses of the pulse signal generated at the driving circuit 108. The number of pulses of the pulse signal output to the motor 107 is counted, by which the number of steps of the motor 107 is counted. It is noted that the thus counted pulse signal is temporarily stored in the RAM 103 as the number of steps of the motor 107.

An image reading unit 20 which reads images of a document is connected to the ASIC 106. The image reading unit 20 reads images of a document on the basis of control programs accommodated in the ROM 102. It is noted that although not shown in FIG. 5, a driving mechanism for reciprocating the image reading unit 20 is also activated on receipt of the output signal from the ASIC 106.

The front sensor 71 is connected to the ASIC 106. On receipt of on and off signals from the sensor, the CPU 101 allows the ASIC 106 to output a predetermined output signal, thereby controlling and driving the motor 107. The history of output signals (on and off signals) from the sensor is stored in the RAM 103.

Further, the first rear sensor 81 and the second rear sensor 82 are connected to the ASIC 106. Upon receipt of on and off signals output from these sensors, the CPU 101 allows the ASIC 106 to output a predetermined output signal, thereby controlling operations of reading images by the image reading unit 20. The details of controlling the operations of reading images will be described later. It is noted that the history of signals output from the sensors (on and off signals) will be stored in the RAM 103.

Figure 6:
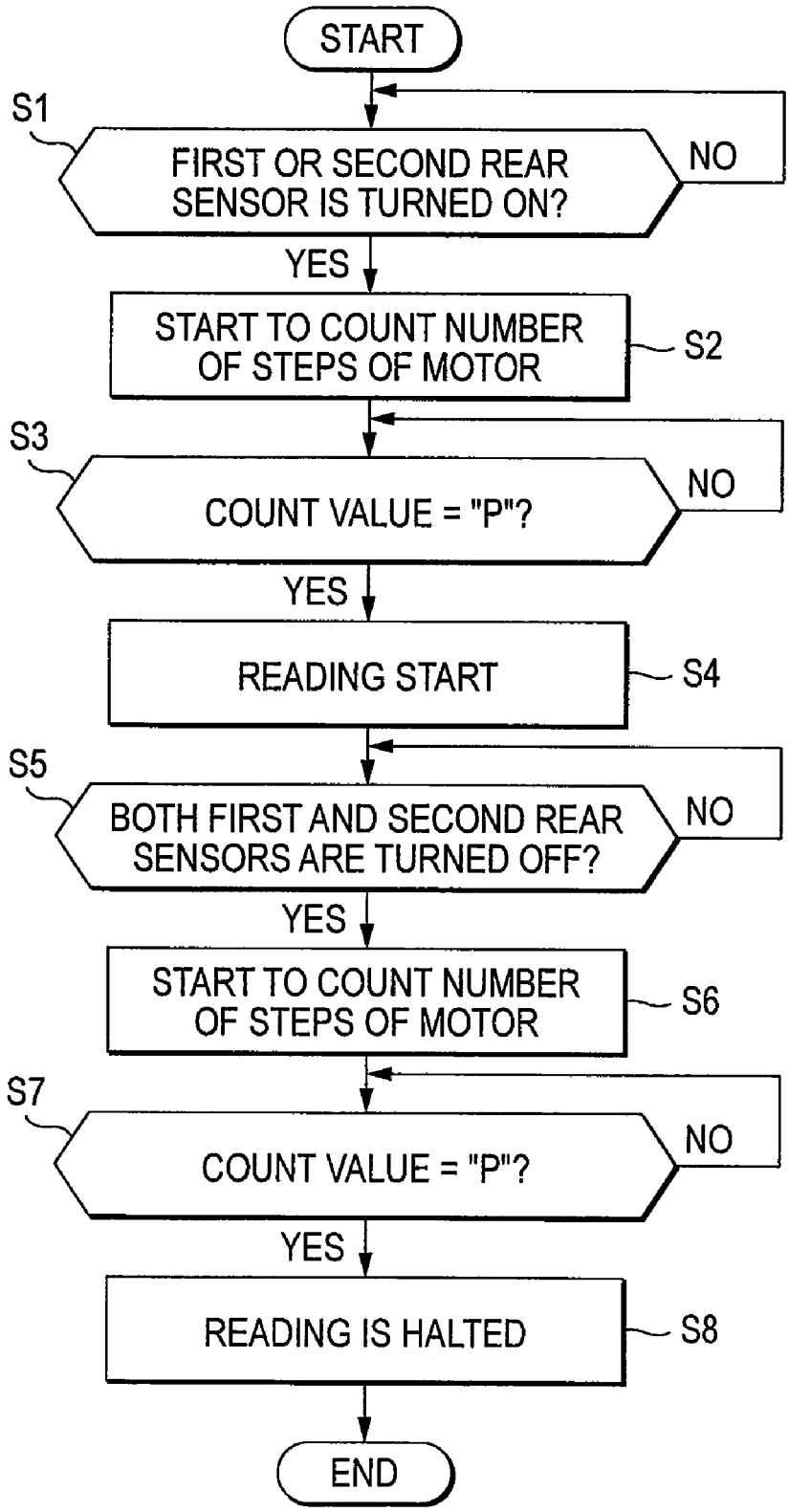
FIG. 6 is a flowchart showing one example of processing procedures for judging the operation timing of the image reading unit 20 executed by the CPU 101.

Next, a description will be given for one example of judgment procedures conducted by the CPU 101 at the controller 100 with reference to FIGS. 4A to 4D and FIG. 6. In this instance, a description will be given for procedures for judging the operation timing of image reading processing (reading start timing and reading completion timing) when the first rear sensor 81 and the second rear sensor 82 are activated at the timings shown in FIGS. 4A and 4B. FIG. 4C is a timing chart showing an operation state of the image reading unit 20, FIG. 4D is a view schematically showing image data read by the image reading unit 20. Further, FIG. 6 is a flowchart showing an example of processing procedures for judging an operation timing of the image reading unit 20 executed by the CPU 101. In FIG. 6, S1, S2, . . . indicates the numbers of processing procedures (steps). The processing will start from Step 1 (S1).

First, in Step 1 (S1), the CPU 101 judges whether either of the first rear sensor 81 or the second rear sensor 82 is turned on. This judgment is made by monitoring a level of signals output from each of the rear sensors 81, 82 (low or high). As shown in FIG. 4A, when the first rear sensor 81 is turned on earlier than the second rear sensor 82, the processing of a next step (S2) is conducted at this time point (time T10) without waiting for the time of turning on the second rear sensor 82.

Subsequently, the CPU 101 counts to start the number of steps of the motor 107 at the time T10 (S2). Thereafter, a judgment is made for whether a count value has reached a predetermined preset number P (S3). In this instance, the predetermined preset number P is the number of steps of the motor 107 which is required from the time point (timing) when the first rear sensor 81 and the second rear sensor 82 detect simultaneously the leading end or the trailing end of a document to the time point when the leading end or the trailing end of the document actually arrives at the reading position of the contact glass plate 27, and accommodated in the RAM 103 after being measured in advance.

In Step 3 (S3), when a judgment is made that the count value has reached the preset number P (Yes in S3), the CPU 101 outputs a starting signal to the image reading unit 20 at a time point (reading start timing) of the time T20 (refer to FIG. 4C). Thereby, the image reading unit 20 starts image reading processing (S4). Such image reading processing will continue until the CPU 101 outputs a halt signal. Image data read by the image reading unit 20 is accumulated and stored in the RAM 103. It is noted that a count value of the number of steps counted in Step 2 (S2) is reset after the start of image reading processing.

Then, in Step 5 (S5), the CPU 101 judges whether both of the first rear sensor 81 and the second rear sensor 82 are turned off. This judgment is made by monitoring a level (low or high) of signals output by each of the rear sensors 81, 82. In S5, the CPU 101 judges that both of the first rear sensor 81 and the second rear sensor 82 are turned off and processing in the next step or Step 6 (S6) is conducted. In other words, the processing in S6 is started at the time point of the time T13 (refer to FIGS. 4A and 4B) when both of the first rear sensor 81 and the second rear sensor 82 are turned off.

In Step 6 (S6), as with the above Step 3 (S3), the CPU 101 starts to count the number of steps of the motor 107 from the time T13. Then, in Step 7 (S7), a judgment is made for whether the count value has reached the above-described preset number P.

In Step 7 (S7), upon judgment that the count value has reached the preset number P (Yes in S7), the CPU 101 outputs a halt signal to the image reading unit 20 at a time point (reading completion timing) of the time T21 (refer to FIG. 4C). Thereby, image reading processing by the image reading unit 20 is halted (S8). It is noted that after the image reading processing is halted, a count value of the number of steps counted in Step 6 (S6) is reset.

It is noted that, as shown in FIG. 3, where the leading end and the trailing end of a document are conveyed along and proximity to the guide face 48, there is found a difference in timing between the results detected by the first rear sensor 81 and by the second rear sensor 82. Therefore, in the above-described Step 4 (S4), when image reading processing is started on the basis of a signal output from the first rear sensor 81 by which the leading end of a document is detected earlier, there is a case where, as shown in FIG. 4D, image reading is started before arrival of the leading end of the document at the reading position, thereby reading an unnecessary image Q1. Further, when the image reading processing is halted at the time when signals output from both the first rear sensor 81 and the second rear sensor 82 are turned off, there is a case where images are read after passage of the document over the reading position and as shown in FIG. 4D, an unnecessary image Q2 is read. These unnecessary images Q1, Q2 are erased by the image processing to be described later after images are read or in the course of reading images.

Figure 7:
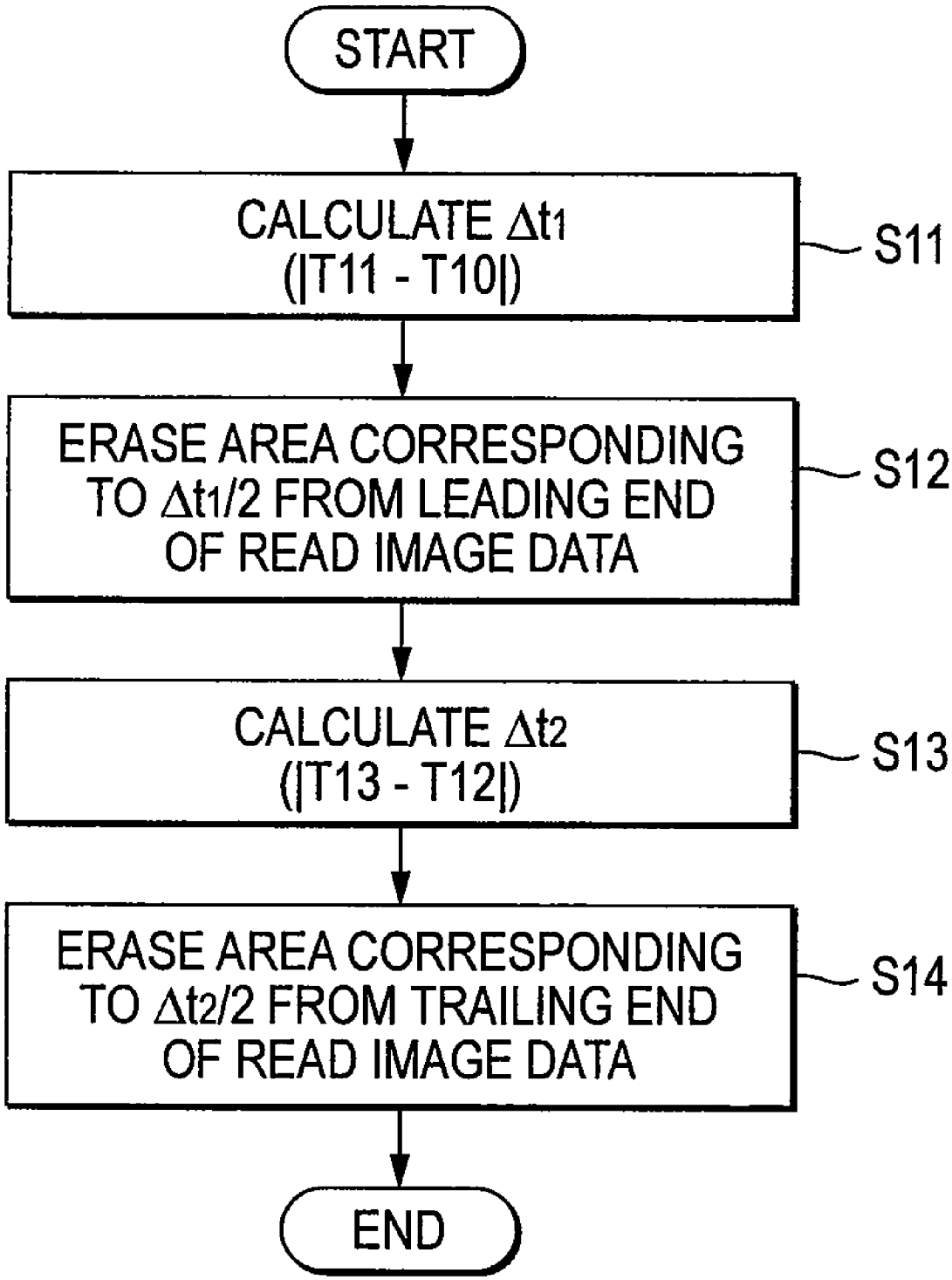
FIG. 7 is a flowchart showing one example of the image processing procedures executed by the CPU 101.

Hereinafter, a description will be given for one example of image processing procedures executed by the CPU 101 at the controller 100 with reference to FIGS. 4A to 4D and FIG. 7. In this instance, FIG. 7 is a flowchart showing one example of image processing procedures executed by the CPU 101. In FIG. 7, S11, S12, . . . denotes the numbers of processing procedures (steps). The processing will be started from Step 11 (S11).

At first, in Step 11 (S11), a difference in detection timing of each of the rear sensors 81, 82, $\Delta t1$ ($=|T11-T10|$) is calculated by the CPU 101 on the basis of the time T10, T11 when both the first rear sensor 81 and the second rear sensor 82 are turned on.

As described above, where the leading end of a document is conveyed along and proximity to the guide face 48 (refer to FIG. 3), there is found the above-described difference $\Delta t1$ in detection timing between the first rear sensor 81 and the second rear sensor 82. On the other hand, where the leading end of the document passes over the center of the curved path 36, each of the rear sensors 81, 82 detects the leading end of the document at the same timing, by which there is found no difference in detection timing between the rear sensors 81, 82. In this instance, with the structure of each of the above-described rear sensors 81, 82 taken into account, each of the rear sensors 81, 82 detects the leading end of the document not at the time point of T10 in FIGS. 4A to 4D or the time point of T11 but at the time point of the average time (T11+T10)/2. Therefore, as described above, even if there is found the above-described difference of Δt1 in detection timing between the rear sensors 81, 82, a value (=Δt1/2) obtained by multiplying the difference Δt1 by ½ is added to the time T10, thereby making it possible to obtain a detection timing (hereinafter, referred to as leading end reference timing)) where the leading end passes over the center of the curved path 36. In the present illustrative aspect, since the preset number P is determined on the basis of the leading end reference timing, in the above-described Step S4 (refer to FIG. 6), an unnecessary image Q1 corresponding to Δt1/2 is included in image data read by the reading start timing on the basis of the first rear sensor 81.

Therefore, the CPU 101 erases an image corresponding to a value (=Δt1/2) obtained by multiplying the difference Δt1 by ½ from image data (read images) stored in the RAM 103 in Step 12 (S12). In other words, of read images, an image Q1 (refer to FIG. 4D) which is read from the time point of starting reading processing (time T20) to the time point when Δt1/2 is elapsed is erased from the read images. Specifically, this processing is conducted so that the number of steps of the motor 107 corresponding to Δt1/2 and the reading resolution of the image reading unit 20 are used to determine the number of lines corresponding to Δt1/2, and image data (image Q1) for the determined number of lines is erased from the leading of the read images stored in the RAM 103. It is noted that the erasing processing is conducted at a storage area of the RAM 103.

Next, in Step 13 (S13), the CPU 101 calculates a difference in detection timing of each of the rear sensors 81, 82 (t2 (=|T13−T12|)) is calculated on the basis of the time T13, T12 when the first rear sensor 81 and the second rear sensor 82 are turned off.

Then, as with the above-described Step 12 (S12), the CPU 101 erases an image corresponding to a value (=Δt2/2) obtained by multiplying the difference Δt2 by ½ from read images stored in the RAM 103 (S14). In detail, of read images, an image Q2 (refer to FIG. 4D) read before only by Δt2/2 from the reading completion time point (time T21) is erased from the read images.

As described above, since unnecessary images Q1 and Q2 are erased from image data read from the time point of the time T20 to the time point of the time T21, it is possible to always obtain a correct read image even if a document is conveyed on any part of the curved path 36.

In the above illustrative aspect, in Step 4 (S4) shown in FIG. 6, a description is made for an example where image reading is started on the basis of a detection timing of the first rear sensor 81 and images Q1 and Q2 are thereafter erased from the thus read image data. However, when the above set value P is greater than the number of steps corresponding to the difference of Δt1 and the difference of Δt2, the reading start timing and the reading completion timing may be determined by the image reading unit 20 on the basis of the difference of Δt1 and the difference of Δt2 in the detection timing of each of the rear sensors 81, 82 before image reading by the image reading unit 20 is started.

Figures 8A, 8B, 8C, 8D:
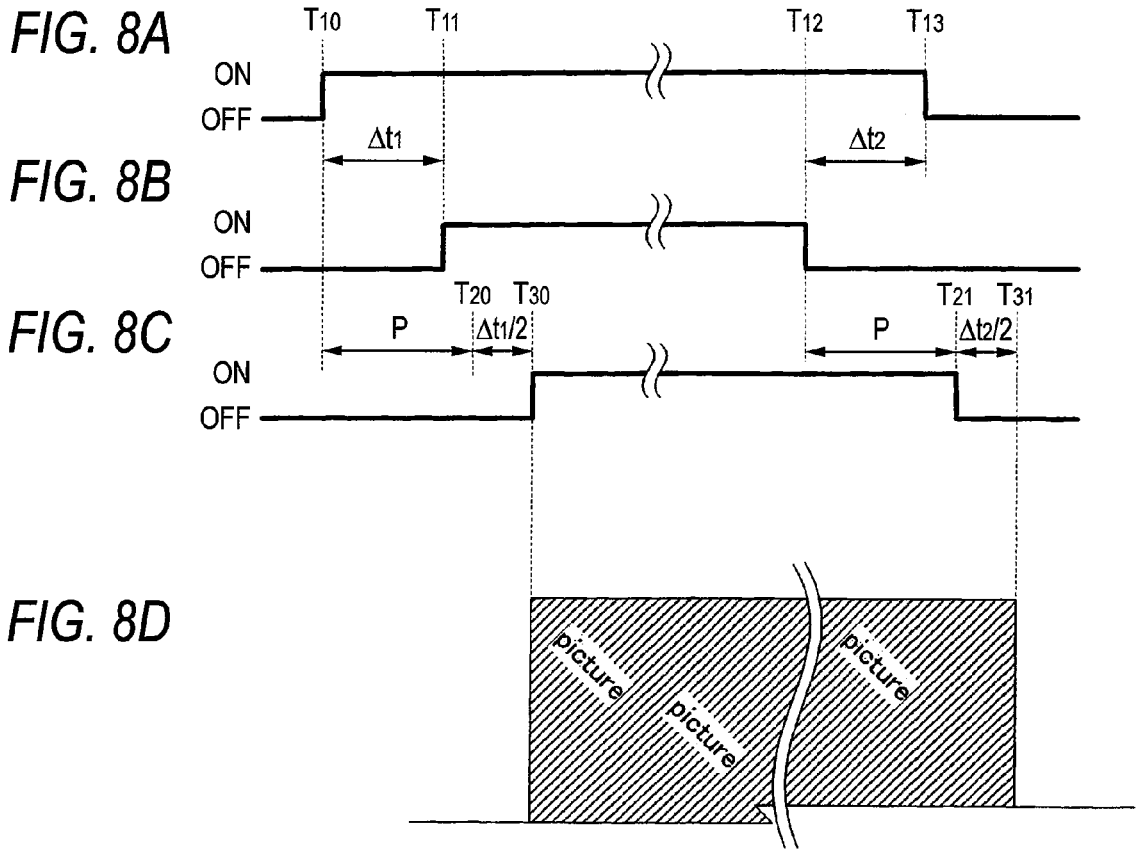
FIGS. 8A to 8D are views showing another example of the respective timing charts of the first rear sensor 81, the second rear sensor 82 and the image reading unit 20 as well as the thus read image data.

Specifically, as shown in FIG. 8, when the leading end is detected by the first rear sensor 81, counting the number of steps of the motor 107 is started from the detected time of T10. When the second rear sensor 82 detects the leading end of a document in the course of counting the number of steps of the motor 107, Δt1/2 is calculated from the detected time of T11 and the above-described time of T10. Then, after the thus counted value has reached the set value P, the number of steps corresponding to the Δt1/2 is further counted, and the time point of the time T30 which counts the number of steps concerned is given as reading start timing. Further, in a similar manner, when the number of steps of the motor 107 is started to count from the time T12 and the first rear sensor 82 detects the trailing end of a document at the time point of the time T13, the time point of the time T31 may be given as reading completion timing. The time point of the time T31 is determined by counting up the number of steps corresponding to Δt2/2 after the count value has reached the set value P. At the above-described timing, image reading a document is started and halted, by which unnecessary images (image Q1 and image Q2) are not included in the leading and end portions of the thus read image data. Thus, there is given a less load to the CPU 101.

Further, in the present illustrative aspect, a description is made for exemplifying the image reading apparatus 10 on which the ADF 12 is mounted, as an example. The present invention is applicable, for example, to a mechanism of conveying recording paper to a position at which ink images or toner images are recorded on the recording paper in an image recording apparatus such as an inject printer and a laser printer, as another aspect. Further, the ADF 12 may be realized as a single product applicable to the image reading apparatus 10, as still another aspect. The present invention is also applicable to these aspects.

According to an aspect of the invention, a sheet conveying device is mainly used on attachment to an image processing apparatus such as an image reading apparatus and an image recording apparatus. The sheet conveying device includes: a conveying path that allows a sheet to be conveyed and includes a first guide face and a second guide face opposing and apart from each other at a predetermined interval; a sheet conveying unit disposed on the conveying path; and a first detecting unit and second detecting unit arranged opposing each other across the conveying path. The first detecting unit includes: a first arm member rotatably supported to take a first posture where the first arm member projected from the first guide face to the conveying path and a second posture where the second arm member is retracted from the conveying path by rotating toward the first guide face; and a first sensor that outputs a signal depending on the first posture or the second posture of the first arm member. Further, the second detecting unit includes: a second arm member rotatably supported to take a third posture where the second arm member is projected from the second guide face to the conveying path and a fourth posture where the second arm member is retracted from the conveying path by rotating toward the second guide face; and a second sensor that outputs a signal depending on the third posture or the fourth posture of the second arm member.

The conveying path is configured by a predetermined interval formed with a first guide face and a second guide face. The conveying path includes the first detecting unit and the second detecting unit. Arm members (a first arm member and a second arm member) provided in each detecting unit retain the first and third postures in a state that no external force is given. When a sheet conveyed by the sheet conveying unit arrives at each detecting unit, the leading end thereof is brought into contact with arm members at the same time. When the leading end of the sheet is in contact with the arm members, each of the arm members is moved rotationally by a force received from the sheet, changing in posture to the second and fourth postures. When the sheet is further conveyed and the trailing end of the sheet has passed over each of the arm members, the arm members are returned to an original posture, that is, the first and third postures, respectively.

Here, for example, it is assumed that the leading end of a sheet would be conveyed along and proximity to a first guide face. In this instance, the leading end of the sheet is brought into contact with the respective arm members of the first detecting unit and the second detecting unit. In the arm member of the first detecting unit, the leading end of the sheet is brought into contact with a position near a supporting point of the arm member. On the other hand, in the arm member of the second detecting unit, the leading end of the sheet is brought into contact with a position distant from a supporting point of the arm member. In each of the arm members, when the distance between the supporting point and the point with which the sheet is in contact changes, the respective rotating speeds of the first arm member and the second arm member, in other words, a displacement of angle with respect to movement differs. This difference causes a timing difference in results detected by the respective detecting unit.

As described above, in the sheet conveying device of the aspect, the first detecting unit and the second detecting unit are provided on the conveying path, thereby making it possible to obtain a signal different in detection timing as a result of detection by the respective detecting unit. It is noted that in a case where the leading end of a sheet is conveyed along and proximity to the second guide face, and in a case where the trailing end is conveyed along and proximity to the first guide face or the second guide face, there is also developed a timing difference, as described above. More specifically, when a sheet moves away from a route which passes at the center of the conveying path, the above-described timing difference can take place inevitably.

The conveying path may have a curved portion. The first detecting unit and the second detecting unit are disposed at the curved portion or downstream of the curved portion in the conveying direction.

When the sheet is conveyed over the curved portion, the sheet is bent upward according to the curvature of a curved portion. In other words, the sheet is curled. The leading end and the trailing end of the sheet is in particular apparently curled. The thus curled extent is not always constant and differs depending on the types of sheets. Further, the extent differs depending on environmental factors. For example, where the air is dried, a sheet is hardly curled, and when the humidity is high, it is easily curled.

The first detecting unit and the second detecting unit are provided on the curved path or at a downstream side thereof in the conveying direction, thereby making it possible to obtain a detection timing depending on types of sheets or environmental factors.

The sheet conveying device may further include an urging member that urges the first arm member to the first posture and the second arm member to the third posture.

The urging member urges the first arm member to the first posture and the second arm member to the third posture. On the other hand, when the sheet is brought into contact with the first arm member and the second arm member, the urge is released on the basis of a force received from the sheet. The thus provided urging member makes it possible to return swiftly the first arm member and the second arm member to the first posture and the third posture, respectively. As a result, responsiveness of the detecting unit is improved.

A rotation angle of the first arm member from the first posture to the second posture may be equal to a rotation angle of the second arm member from the third posture to the fourth posture.

Thereby, the results detected respectively by the first detecting unit and the second detecting unit become correlative.

The sheet conveying device may further include a first judgment unit configured to judge that an end of the sheet has arrived at a predetermined position on the conveying path based on detection results of the first detecting unit and the second detecting unit.

Thereby, it is possible to judge whether the leading end or the trailing end of a sheet has arrived at the predetermined position.

The first judgment unit may judge that the end of the sheet has arrived at the predetermined position on the conveying path based a difference in the detection results of the first detecting unit and the second detecting unit.

The sheet conveying device may further includes: an image processing unit disposed downstream of the first detecting unit and the second detecting unit on the conveying path and configured to perform a predetermined image processing to the sheet to be conveyed; and a control unit configured to control an operation of the image processing unit based on the detection results of the first detecting unit and the second detecting unit.

According to the above-described configuration, the detection results of the first detecting unit and the second detecting unit are supplied to the control unit. The control unit controls the operation of the image processing unit based on the above detection results. Thereby, increased is the accuracy of image processing by the image processing unit.

The predetermined image processing may include an image reading processing that reads images of the sheet conveyed to a reading position.

It is thereby possible to realize a correct image reading and obtain a read image stable in quality.

The control unit may include a second judgment unit configured to judge the start timing and the completion timing of the predetermined image processing by the image processing unit based on the detection results of the first detecting unit and the second detecting unit.

On the assumption that the detecting unit is provided in one unit, only one result would be provided for every conveyance of a sheet. Therefore, since sheets moving on the conveying path do not always pass over a definite route, there is found a deviation of detection timing every time a sheet is detected. This deviation makes unstable the start timing or the completion timing of image processing such as image reading processing, thereby affecting the correctness of the image processing. The sheet conveying device includes the above-described first detecting unit and the second detecting unit. Based on the respective detection results from these detecting unit, a judgment is made for the start timing and the completion timing of predetermined image processing to correctly provide the start timing and the completion timing. As described above, the predetermined image processing is performed at each of the correctly judged timings to improve the accuracy of image processing.

The second judgment unit may judge the start timing and the completion timing of the predetermined image processing based on a difference in the detection results of the first detecting unit and the second detecting unit.

The control unit may include: a third judgment unit configured to judge the start timing of the image reading processing by the image processing unit based on one of the detection results of the first detecting unit and the second detecting unit which has detected the leading end of the sheet earlier and also judge the completion timing of the image reading processing based on one of the detection results of the first detecting unit or the second detecting unit which has detected the trailing end of the sheet later; and an image erasing unit configured to erase a predetermined area after start of reading or a predetermined area before completion of reading from an image read by the image reading processing based on the detection results of the first detecting unit and the second detecting unit.

Thereby, the image erasing unit is used to erase a predetermined area after start of reading or a predetermined area before completion of reading, of images read by the image reading processing, based on a difference in results detected by the first detecting unit and the second detecting unit. As a result, even if there is found a difference in detection timing every time a sheet is detected, it is possible to provide a read image stable in quality.

What is claimed is:

1. A sheet conveying device comprising:

a conveying path that allows a sheet to be conveyed and includes a first guide face and a second guide face opposing and apart from each other at a predetermined interval;

a sheet conveying unit disposed on the conveying path;

a first detecting unit and a second detecting unit arranged opposing each other across the conveying path, wherein the first detecting unit includes:

a first arm member rotatably supported to take a first posture where the first arm member is projected from the first guide face to the conveying path and a second posture where the second arm member is retracted from the conveying path by rotating toward the first guide face; and a first sensor that outputs a signal depending on the first posture or the second posture of the first arm member, and wherein the second detecting unit includes:

a second arm member rotatably supported to take a third posture where the second arm member is projected from the second guide face to the conveying path and a fourth posture where the second arm member is retracted from the conveying path by rotating toward the second guide face; and a second sensor that outputs a signal depending on the third posture or the fourth posture of the second arm member; and an image processing unit disposed downstream of the first detecting unit and the second detecting unit on the conveying path and configured to perform a predetermined image processing to the sheet to be conveyed; and a control unit configured to control an operation of the image processing unit based on the detection results of the first detecting unit and the second detecting unit.

2. The sheet conveying device according to claim 1, wherein the conveying path has a curved portion, and wherein the first detecting unit and the second detecting unit are disposed at the curved portion or downstream of the curved portion in the conveying direction.

3. The sheet conveying device according to claim 1, further comprising an urging member that urges the first arm member to the first posture and the second arm member to the third posture.

4. The sheet conveying device according to claim 1, wherein a rotation angle of the first arm member from the first posture to the second posture is equal to a rotation angle of the second arm member from the third posture to the fourth posture.

5. The sheet conveying device according to claim 1, further comprising a judgment unit configured to judge that an end of the sheet has arrived at a predetermined position on the conveying path based on detection results of the first detecting unit and the second detecting unit.

6. The sheet conveying device according to claim 5, wherein the judgment unit judges that the end of the sheet has arrived at the predetermined position on the conveying path based on a difference in the detection results of the first detecting unit and the second detecting unit.

7. The sheet conveying device according to claim 1, wherein the predetermined image processing includes an image reading processing that reads images of the sheet conveyed to a reading position.

8. The sheet conveying device according to claim 7, wherein the control unit includes:

a judgment unit configured to judge the start timing of the image reading processing by the image processing unit based on one of the detection results of the first detecting unit and the second detecting unit which has detected the leading end of the sheet earlier and also judge the completion timing of the image reading processing based on one of the detection results of the first detecting unit and the second detecting unit which has detected the trailing end of the sheet later; and an image erasing unit configured to erase a predetermined area after start of reading or a predetermined area before completion of reading from an image read by the image reading processing based on a difference in the detection results of the first detecting unit and the second detecting unit.

9. The sheet conveying device according to claim 1, wherein the control unit includes a judgment unit configured to judge start timing and completion timing of the predetermined image processing by the image processing unit based on the detection results of the first detecting unit and the second detecting unit.

10. The sheet conveying device according to claim 9, wherein the judgment unit judges the start timing and the completion timing of the predetermined image processing based on a difference in the detection results of the first detecting unit and the second detecting unit.

11. The sheet conveying device according to claim 1, wherein the first arm member and the second arm member respectively have a first face and a second face that are to contact a leading end of the sheet conveyed in the conveying path, wherein the first face in the first posture and the second face in the first posture are overlapped when viewed from cross section of the conveying path.

12. The sheet conveying device according to claim 1, wherein the first arm member at the first posture extends from the first guide face to the second guide face when viewed from the cross section of the conveying path, and wherein the second arm member at the third posture extends from the second guide face to the first guide face when viewed from the cross section of the conveying path.

13. A sheet conveying device comprising:

a conveying path that allows a sheet to be conveyed and includes a first guide face and a second guide face opposing and apart from each other at a predetermined interval;

a sheet conveying means disposed on the conveying path;

a first detecting means and a second detecting means arranged opposing each other across the conveying path, wherein the first detecting means includes:

a first arm member rotatably supported to take a first posture where the first arm member is projected from the first guide face to the conveying path and a second posture where the second arm member is retracted from the conveying path by rotating toward the first guide face; and a first sensor that outputs a signal depending on the first posture or the second posture of the first arm member, and wherein the second detecting means includes:

a second arm member rotatably supported to take a third posture where the second arm member is projected from the second guide face to the conveying path and a fourth posture where the second arm member is retracted from the conveying path by rotating toward the second guide face; and a second sensor that outputs a signal depending on the third posture or the fourth posture of the second arm member;

image processing means, disposed downstream of the first detecting unit and the second detecting unit on the conveying path, for performing a predetermined image processing to the sheet to be conveyed; and control means for controlling an operation of the image processing unit based on the detection results of the first detecting unit and the second detecting unit.

14. The sheet conveying device according to claim 13, wherein the first arm member at the first posture extends from the first guide face to the second guide face when viewed from the cross section of the conveying path, and wherein the second arm member at the third posture extends from the second guide face to the first guide face when viewed from the cross section of the conveying path.

* * * * *